US007789158B2

(12) United States Patent
Zupanick

(10) Patent No.: US 7,789,158 B2
(45) Date of Patent: Sep. 7, 2010

(54) FLOW CONTROL SYSTEM HAVING A DOWNHOLE CHECK VALVE SELECTIVELY OPERABLE FROM A SURFACE OF A WELL

(75) Inventor: Joseph A. Zupanick, Pineville, WV (US)

(73) Assignee: Pine Tree Gas, LLC, Pineville, WV (US)

( * ) Notice: Subject to any disclaimer, the term of this patent is extended or adjusted under 35 U.S.C. 154(b) by 87 days.

(21) Appl. No.: 12/184,988

(22) Filed: Aug. 1, 2008

(65) Prior Publication Data

US 2009/0050312 A1 Feb. 26, 2009

Related U.S. Application Data

(60) Provisional application No. 60/963,337, filed on Aug. 3, 2007, provisional application No. 61/002,419, filed on Nov. 7, 2007.

(51) Int. Cl.
*E21B 43/00* (2006.01)

(52) U.S. Cl. ..... 166/370; 166/263; 166/265; 166/266; 166/105.5

(58) Field of Classification Search ..... 166/370, 166/105.5, 265, 266, 263
See application file for complete search history.

(56) References Cited

U.S. PATENT DOCUMENTS

| | | | |
|---|---|---|---|
| 2,810,352 | A | 10/1957 | Tumilson |
| 2,850,097 | A | 9/1958 | Bloom |
| 3,199,592 | A | 8/1965 | Jacob |
| 3,266,574 | A | 8/1966 | Gandy et al. |
| 3,289,764 | A | 12/1966 | Santourian |
| 3,363,692 | A | 1/1968 | Bishop |
| 3,366,074 | A | 1/1968 | Shirley |
| 3,433,301 | A | 3/1969 | McEver, Jr. |
| 3,460,625 | A | 8/1969 | Ellis |
| 3,493,052 | A | 2/1970 | Boehm |
| 3,497,009 | A | 2/1970 | Harrington |

(Continued)

FOREIGN PATENT DOCUMENTS

CA 2313617 A1 1/2002

(Continued)

OTHER PUBLICATIONS

International Search Report and Written Opinion date mailed Dec. 29, 2008; International Patent Application No. PCT/US2008/072012.

(Continued)

*Primary Examiner*—Daniel P Stephenson
*Assistant Examiner*—Michael Wills, III
(74) *Attorney, Agent, or Firm*—Sonnenschein Nath & Rosenthal LLP

(57) ABSTRACT

A flow control system includes a pump positioned in a well to remove liquid from the well. A check valve is positioned in the well and includes an open position and a closed position. The check valve in the open position allows gas from a producing formation of the well to flow past the check valve, while the check valve in the closed position substantially reduces gas flow at the pump from the producing formation. A compressed gas source is in fluid communication with the well to provide compressed gas to move the check valve to the closed position.

22 Claims, 21 Drawing Sheets

U.S. PATENT DOCUMENTS

| | | | | |
|---|---|---|---|---|
| 3,580,333 | A | | 5/1971 | Douglas |
| 3,647,230 | A | | 3/1972 | Smedley |
| 3,678,997 | A | | 7/1972 | Barchard |
| 3,764,235 | A | | 10/1973 | Bittermann |
| 3,861,471 | A | | 1/1975 | Douglas |
| 3,876,000 | A | | 4/1975 | Nutter |
| 3,912,008 | A | | 10/1975 | Crowe |
| 3,926,254 | A | | 12/1975 | Evans et al. |
| 3,930,538 | A | | 1/1976 | Brennan et al. |
| 3,937,025 | A | | 2/1976 | Alvarez-Calderon |
| 3,971,437 | A | | 7/1976 | Clay |
| 4,072,015 | A | | 2/1978 | Morrell et al. |
| 4,226,284 | A | | 10/1980 | Evans |
| 4,275,790 | A | | 6/1981 | Abercrombie |
| 4,278,131 | A | | 7/1981 | Jani |
| 4,295,795 | A | | 10/1981 | Gass et al. |
| 4,372,389 | A | | 2/1983 | Hamrick et al. |
| 4,386,654 | A | | 6/1983 | Becker |
| 4,437,514 | A | | 3/1984 | Canalizo |
| 4,474,409 | A | | 10/1984 | Trevits |
| 4,573,536 | A | | 3/1986 | Lawrence |
| 4,596,516 | A | | 6/1986 | Scott et al. |
| 4,601,335 | A | | 7/1986 | Murahashi |
| 4,605,067 | A | | 8/1986 | Burton, Jr. |
| 4,625,801 | A | | 12/1986 | McLauglin |
| 4,643,258 | A | * | 2/1987 | Kime ..... 166/369 |
| 4,683,945 | A | | 8/1987 | Rozsa |
| 4,711,306 | A | | 12/1987 | Bobo |
| 4,716,555 | A | | 12/1987 | Bodine |
| 4,730,634 | A | | 3/1988 | Russell |
| 4,762,176 | A | | 8/1988 | Miller |
| 4,766,957 | A | | 8/1988 | McIntyre |
| 4,793,417 | A | | 12/1988 | Rumbaugh |
| 4,823,880 | A | | 4/1989 | Klatt |
| 4,927,292 | A | | 5/1990 | Justice |
| 4,962,812 | A | | 10/1990 | Berzin |
| 4,990,061 | A | | 2/1991 | Fowler et al. |
| 5,020,592 | A | | 6/1991 | Muller et al. |
| 5,033,550 | A | | 7/1991 | Johnson et al. |
| 5,059,064 | A | | 10/1991 | Justice |
| 5,113,937 | A | | 5/1992 | Cholet |
| 5,147,149 | A | | 9/1992 | Craig et al. |
| 5,183,114 | A | | 2/1993 | Mashaw, Jr. et al. |
| 5,186,258 | A | | 2/1993 | Wood et al. |
| 5,201,369 | A | | 4/1993 | Berzin et al. |
| 5,211,242 | A | | 5/1993 | Coleman et al. |
| 5,229,017 | A | | 7/1993 | Nimerick et al. |
| 5,311,936 | A | | 5/1994 | McNair et al. |
| 5,333,684 | A | | 8/1994 | Walter et al. |
| 5,411,104 | A | | 5/1995 | Stanley |
| 5,425,416 | A | | 6/1995 | Hammeke et al. |
| 5,431,229 | A | | 7/1995 | Christensen |
| 5,462,116 | A | | 10/1995 | Carroll |
| 5,479,989 | A | | 1/1996 | Shy et al. |
| 5,482,117 | A | | 1/1996 | Kolpak et al. |
| 5,488,993 | A | | 2/1996 | Hershberger |
| 5,501,279 | A | | 3/1996 | Garg et al. |
| 5,507,343 | A | | 4/1996 | Carlton et al. |
| 5,520,248 | A | | 5/1996 | Sisson et al. |
| 5,549,160 | A | | 8/1996 | Bownes et al. |
| 5,582,247 | A | | 12/1996 | Brett et al. |
| 5,588,486 | A | | 12/1996 | Heinrichs |
| 5,605,195 | A | | 2/1997 | Eslinger et al. |
| 5,634,522 | A | | 6/1997 | Hershberger |
| 5,697,448 | A | | 12/1997 | Johnson |
| 5,725,053 | A | | 3/1998 | Weber |
| 5,799,733 | A | | 9/1998 | Ringgenberg et al. |
| 5,826,659 | A | | 10/1998 | Hershberger |
| 5,857,519 | A | | 1/1999 | Bowlin et al. |
| 5,871,051 | A | | 2/1999 | Mann |
| 5,879,057 | A | | 3/1999 | Schwoebel et al. |
| 5,881,814 | A | | 3/1999 | Mills |
| 5,899,270 | A | | 5/1999 | Watson |
| 5,941,307 | A | | 8/1999 | Tubel |
| 6,039,121 | A | | 3/2000 | Kisman |
| 6,089,322 | A | | 7/2000 | Kelley et al. |
| 6,131,655 | A | | 10/2000 | Shaw |
| 6,135,210 | A | | 10/2000 | Rivas |
| 6,138,764 | A | | 10/2000 | Scarsdale et al. |
| 6,148,923 | A | | 11/2000 | Casey |
| 6,155,347 | A | | 12/2000 | Mills |
| 6,182,751 | B1 | | 2/2001 | Koshkin |
| 6,279,660 | B1 | | 8/2001 | Hay |
| 6,280,000 | B1 | | 8/2001 | Zupanick |
| 6,287,208 | B1 | | 9/2001 | Faulkenberry et al. |
| 6,289,990 | B1 | | 9/2001 | Dillon et al. |
| 6,302,214 | B1 | | 10/2001 | Carmichael et al. |
| 6,328,109 | B1 | | 12/2001 | Pringle et al. |
| 6,357,523 | B1 | | 3/2002 | Zupanick |
| 6,382,321 | B1 | | 5/2002 | Bates et al. |
| 6,412,556 | B1 | | 7/2002 | Zupanick |
| 6,422,318 | B1 | | 7/2002 | Rider |
| 6,425,448 | B1 | | 7/2002 | Zupanick et al. |
| 6,439,320 | B2 | | 8/2002 | Zupanick |
| 6,454,000 | B1 | | 9/2002 | Zupanick |
| 6,478,085 | B2 | | 11/2002 | Zupanick |
| 6,497,556 | B2 | | 12/2002 | Zupanick et al. |
| 6,497,561 | B2 | | 12/2002 | Skillman |
| 6,516,879 | B1 | | 2/2003 | Hershberger |
| 6,554,069 | B1 | | 4/2003 | Chatterji et al. |
| 6,561,288 | B2 | | 5/2003 | Zupanick |
| 6,575,235 | B2 | | 6/2003 | Zupanick et al. |
| 6,585,049 | B2 | | 7/2003 | Leniek, Sr. |
| 6,595,301 | B1 | | 7/2003 | Zupanick et al. |
| 6,598,686 | B1 | | 7/2003 | Zupanick |
| 6,604,580 | B2 | | 8/2003 | Zupanick et al. |
| 6,604,910 | B1 | | 8/2003 | Zupanick |
| 6,623,252 | B2 | | 9/2003 | Cunningham |
| 6,629,566 | B2 | | 10/2003 | Liknes |
| 6,637,510 | B2 | | 10/2003 | Lee |
| 6,651,740 | B2 | | 11/2003 | Kobylinski et al. |
| 6,660,693 | B2 | | 12/2003 | Miller et al. |
| 6,662,870 | B1 | | 12/2003 | Zupanick |
| 6,668,918 | B2 | | 12/2003 | Zupanick |
| 6,668,925 | B2 | | 12/2003 | Shaw et al. |
| 6,672,392 | B2 | | 1/2004 | Reitz |
| 6,679,322 | B1 | | 1/2004 | Zupanick |
| 6,681,855 | B2 | | 1/2004 | Zupanick et al. |
| 6,688,388 | B2 | | 2/2004 | Zupanick |
| 6,691,781 | B2 | | 2/2004 | Grant et al. |
| 6,705,397 | B2 | | 3/2004 | Hershberger |
| 6,705,402 | B2 | | 3/2004 | Proctor |
| 6,705,404 | B2 | | 3/2004 | Bosley |
| 6,708,764 | B2 | | 3/2004 | Zupanick |
| 6,715,556 | B2 | | 4/2004 | Mack et al. |
| 6,722,452 | B1 | | 4/2004 | Rial et al. |
| 6,725,922 | B2 | | 4/2004 | Zupanick |
| 6,729,391 | B2 | | 5/2004 | Hill et al. |
| 6,732,792 | B2 | | 5/2004 | Zupanick |
| 6,769,486 | B2 | | 8/2004 | Lim et al. |
| 6,779,608 | B2 | | 8/2004 | Grubb et al. |
| 6,848,508 | B2 | | 2/2005 | Zupanick |
| 6,851,479 | B1 | | 2/2005 | Zupanick et al. |
| 6,860,921 | B2 | | 3/2005 | Hopper |
| 6,889,765 | B1 | | 5/2005 | Traylor |
| 6,932,160 | B2 | | 8/2005 | Murray et al. |
| 6,942,030 | B2 | | 9/2005 | Zupanick |
| 6,945,755 | B2 | | 9/2005 | Zupanick et al. |
| 6,945,762 | B2 | | 9/2005 | Williams |
| 6,953,088 | B2 | | 10/2005 | Rial et al. |
| 6,962,216 | B2 | | 11/2005 | Zupanick |
| 6,964,298 | B2 | | 11/2005 | Zupanick |
| 6,964,308 | B1 | | 11/2005 | Zupanick |
| 6,968,893 | B2 | | 11/2005 | Rusby et al. |

| | | | | |
|---|---|---|---|---|
| 6,976,533 | B2 | 12/2005 | Zupanick | |
| 6,976,547 | B2 | 12/2005 | Rial et al. | |
| 6,986,388 | B2 | 1/2006 | Zupanick et al. | |
| 6,988,548 | B2 | 1/2006 | Diamond et al. | |
| 6,988,566 | B2 | 1/2006 | Zupanick et al. | |
| 6,991,047 | B2 | 1/2006 | Zupanick | |
| 6,991,048 | B2 | 1/2006 | Zupanick | |
| 7,007,758 | B2 | 3/2006 | Zupanick et al. | |
| 7,025,137 | B2 | 4/2006 | Zupanick | |
| 7,025,154 | B2 | 4/2006 | Zupanick | |
| 7,036,584 | B2 | 5/2006 | Zupanick et al. | |
| 7,048,049 | B2 | 5/2006 | Zupanick | |
| 7,055,595 | B2 | 6/2006 | Mack et al. | |
| 7,073,594 | B2 | 7/2006 | Stegemeier et al. | |
| 7,073,595 | B2 | 7/2006 | Zupanick et al. | |
| 7,086,470 | B2 | 8/2006 | Diamond et al. | |
| 7,090,009 | B2 | 8/2006 | Zupanick | |
| 7,134,494 | B2 | 11/2006 | Zupanick et al. | |
| 7,178,611 | B2 | 2/2007 | Zupanick | |
| 7,182,157 | B2 | 2/2007 | Zupanick | |
| 7,207,395 | B2 | 4/2007 | Zupanick | |
| 7,213,644 | B1 | 5/2007 | Zupanick | |
| 7,222,670 | B2 | 5/2007 | Zupanick | |
| 7,225,872 | B2 | 6/2007 | Zupanick | |
| 7,228,914 | B2 * | 6/2007 | Chavers et al. | 166/386 |
| 7,243,738 | B2 | 7/2007 | Gardes | |
| 7,264,048 | B2 | 9/2007 | Zupanick et al. | |
| 7,311,150 | B2 | 12/2007 | Zupanick | |
| 7,331,392 | B2 | 2/2008 | Bosley et al. | |
| 7,353,877 | B2 | 4/2008 | Zupanick | |
| 7,360,595 | B2 | 4/2008 | Zupanick et al. | |
| 7,419,007 | B2 | 9/2008 | Belcher et al. | |
| 7,434,620 | B1 | 10/2008 | Zupanick | |
| 7,543,648 | B2 | 6/2009 | Hill et al. | |
| 2001/0010432 | A1 | 8/2001 | Zupanick | |
| 2001/0015574 | A1 | 8/2001 | Zupanick | |
| 2002/0108746 | A1 | 8/2002 | Zupanick | |
| 2002/0117297 | A1 | 8/2002 | Zupanick | |
| 2002/0134546 | A1 | 9/2002 | Zupanick | |
| 2002/0148605 | A1 | 10/2002 | Zupanick | |
| 2002/0148613 | A1 | 10/2002 | Zupanick | |
| 2002/0148647 | A1 | 10/2002 | Zupanick | |
| 2002/0153141 | A1 | 10/2002 | Hartman et al. | |
| 2002/0155003 | A1 | 10/2002 | Zupanick | |
| 2002/0189801 | A1 | 12/2002 | Zupanick | |
| 2003/0047310 | A1 | 3/2003 | Thomas | |
| 2003/0075322 | A1 | 4/2003 | Zupanick | |
| 2003/0217842 | A1 | 11/2003 | Zupanick | |
| 2004/0007353 | A1 | 1/2004 | Stave | |
| 2004/0031609 | A1 | 2/2004 | Zupanick | |
| 2004/0060705 | A1 | 4/2004 | Kelley | |
| 2004/0084183 | A1 | 5/2004 | Zupanick | |
| 2004/0108110 | A1 | 6/2004 | Zupanick | |
| 2004/0149432 | A1 | 8/2004 | Zupanick | |
| 2004/0154802 | A1 | 8/2004 | Zupanick | |
| 2004/0159436 | A1 | 8/2004 | Zupanick | |
| 2004/0206493 | A1 | 10/2004 | Zupanick | |
| 2004/0244974 | A1 | 12/2004 | Zupanick | |
| 2005/0045333 | A1 | 3/2005 | Tessier et al. | |
| 2005/0079063 | A1 | 4/2005 | Zupanick | |
| 2005/0087340 | A1 | 4/2005 | Zupanick | |
| 2005/0115709 | A1 | 6/2005 | Zupanick | |
| 2005/0133219 | A1 | 6/2005 | Zupanick | |
| 2005/0163640 | A1 | 7/2005 | Sieben | |
| 2005/0167156 | A1 | 8/2005 | Zupanick | |
| 2005/0189117 | A1 | 9/2005 | Pringle et al. | |
| 2005/0211471 | A1 | 9/2005 | Zupanick | |
| 2005/0211473 | A1 | 9/2005 | Zupanick | |
| 2005/0217860 | A1 | 10/2005 | Mack et al. | |
| 2005/0257962 | A1 | 11/2005 | Zupanick | |
| 2006/0045767 | A1 | 3/2006 | Liknes | |
| 2006/0045781 | A1 | 3/2006 | Liknes | |
| 2006/0048947 | A1 | 3/2006 | Hall et al. | |
| 2006/0090906 | A1 | 5/2006 | Themig | |
| 2006/0096755 | A1 | 5/2006 | Zupanick | |
| 2006/0131029 | A1 | 6/2006 | Zupanick | |
| 2006/0266526 | A1 | 11/2006 | Ocalan et al. | |
| 2007/0199691 | A1 | 8/2007 | Heller et al. | |
| 2007/0235196 | A1 | 10/2007 | Brown et al. | |
| 2008/0060571 | A1 | 3/2008 | Zupanick | |
| 2008/0060799 | A1 | 3/2008 | Zupanick | |
| 2008/0060804 | A1 | 3/2008 | Zupanick | |
| 2008/0060805 | A1 | 3/2008 | Zupanick | |
| 2008/0060806 | A1 | 3/2008 | Zupanick | |
| 2008/0060807 | A1 | 3/2008 | Zupanick | |
| 2008/0066903 | A1 | 3/2008 | Zupanick | |
| 2008/0149349 | A1 | 6/2008 | Hiron et al. | |
| 2008/0245525 | A1 | 10/2008 | Rivas et al. | |
| 2009/0008101 | A1 * | 1/2009 | Coady | 166/370 |
| 2009/0032244 | A1 | 2/2009 | Zupanick | |
| 2009/0084534 | A1 | 4/2009 | Zupanick | |

FOREIGN PATENT DOCUMENTS

| | | | |
|---|---|---|---|
| CA | 2350453 | A1 | 1/2002 |
| WO | WO 95/33119 | A1 | 12/1995 |
| WO | WO 98/03766 | A1 | 1/1998 |

OTHER PUBLICATIONS

Hutlas, et al "A Practical Approach to Removing Gas Well Liquids", Journal of Petroleum Technology, vol. 24, No. 8, Aug. 1972, pp. 916-922.

Restriction Requirement dated May 11, 2009 for U.S. Appl. No. 12/184,978.

Response filed Jun. 10, 2009 to Restriction Requirement dated May 11, 2009 for U.S. Appl. No. 12/184,978.

International Search Report and Written Opinion date mailed May 11, 2009 for PCT International Application No. PCT/US2009/37136.

Response filed Apr. 15, 2010 to Non-Final Action date mailed Apr. 15, 2010 in U.S. Appl. No. 12/184,960.

Supplemental Response filed May 6, 2010 in U.S. Appl. No. 12/184,960.

Non-Final Rejection date mailed Apr. 23, 2010 in U.S. Appl. No. 12/184,972.

Final Rejection date mailed Mar. 19, 2010 in U.S. Appl. No. 12/184,978.

Examiner Interview Summary date mailed Apr. 26, 2010 in U.S. Appl. No. 12/184,978.

RCE/Amendment filed May 6, 2010 in U.S. Appl. No. 12/184,978.

Response filed Feb. 12, 2010 to Non-Final Action dated Nov. 12, 2009 in U.S. Appl. No. 12/184,984.

Examiner Interview Summary date mailed Feb. 18, 2010 in U.S. Appl. No. 12/184,984.

Non-Final Office Action date mailed Jan. 15, 2010 for U.S. Appl. No. 12/184,960.

Non-Final Office Action date mailed Sep. 28, 2009 for U.S. Appl. No. 12/184,978.

Response filed Dec. 28, 2009 to Non-Final Office Action date mailed Sep. 28, 2009 for U.S. Appl. No. 12/184,978.

Interview Summary date mailed Dec. 29, 2009 for U.S. Appl. No. 12/184,978.

Non-Final Office Action date mailed Nov. 12, 2009 for U.S. Appl. No. 12/184,984.

Notice of Allowance date mailed Jun. 2, 2010 in U.S. Appl. No. 12/184,960.

Non-Final Action date mailed May 25, 2010 in U.S. Appl. No. 12/184,965.

Notice of Allowance date mailed Jun. 29, 2010 in U.S. Appl. No. 12/184,978.

* cited by examiner

FLOW CONTROL SYSTEM HAVING A DOWNHOLE CHECK VALVE SELECTIVELY OPERABLE FROM A SURFACE OF A WELL

CROSS-REFERENCE TO RELATED APPLICATIONS

This application claims the benefit of U.S. Provisional Application No. 60/963,337, filed Aug. 3, 2007, and U.S. Provisional Application No. 61/002,419, filed Nov. 7, 2007, both of which are hereby incorporated by reference.

BACKGROUND

1. Field of the Invention

The invention relates generally to the recovery of subterranean deposits and more specifically to methods and systems for controlling the accumulation of liquids in a well.

2. Description of Related Art

Gas wells, especially those in which coal-bed methane is produced, may experience large influxes of water downhole that must be removed by pumping to ensure adequate gas production. The pumping system must be designed to assure the pump can effectively remove the produced water from the well. One design criteria recognizes the issue of gas interference. Gas interference is caused when gas, flowing into the suction of the pump, "interferes" with the volumetric efficiency of the pump. To avoid gas interference problems in vertical wells, pumps are frequently placed in a sump or "rat-hole" below the point where the production fluids enter the well. In this configuration, gravity separation allows the lower density gas phase to rise, while the higher density liquids drop into the rat-hole for removal by the pump.

Most downhole pumping systems are designed to handle only a liquid phase. Referring to FIG. 1, when liquid 112 and gas 114 are co-produced in a well 110, the pumping equipment 118 should be configured such that only liquids enter inlets 122 of the pump 118. When two-phase fluids enter a pump, the gas phase can displace an equivalent volume of liquid, thus causing inefficient volumetric pump efficiency. Further problems can result from the compressible nature of the gas, resulting in "gas lock" of the pumping equipment. In addition, due to the diminished flow of the lubricating and cooling liquid through the pump, increased frictional wear can reduce pump life.

Natural gravity separation of gas and liquids becomes more difficult in horizontal wells. If the pump is located in the horizontal section of the well, gravity separation of the fluid is not feasible. Referring to FIG. 2, occasionally in a well 210 having a substantially horizontal portion 214 and a substantially vertical portion 218, a sump or rat-hole is drilled at some point along a curve 226 between the substantially horizontal portion 214 and the substantially vertical portion 218. Frequently, the rat-hole 222 is drilled near the high angle, or vertical section of the well. A pump 230 is placed within the rat-hole 222 and may be driven by a motor 234 positioned at a surface 238 of the well 210. The motor 234 powers the pump 230 via a drive shaft, or tubing string 242. The pump 230 permits removal of liquids from the rat-hole 222, and the liquids in the rat-hole 222 are generally not entrained with gas due to gravity separation. Although separation of the gas and liquid may be successful at this point, the producing formation is exposed to additional fluid head pressure as the column of fluid must build to the vertical head, H, of the rat-hole junction above that of the producing horizontal bore. In some instances involving pressure sensitive formations, this conflicts with the goal to minimize fluid head against such formations. Alternatively, a rat-hole 230 may be drilled near the low angle, or horizontal section of the well; however, as the inclination at the rat-hole departs from vertical, the liquid-gas phase separation efficiency declines. As such, gas interference may still hinder liquid production from the pump, causing the liquid level to rise and create unwanted head against the producing formation.

SUMMARY

The problems presented in removing liquid from a gas-producing well are solved by the systems and methods of the illustrative embodiments described herein. In one embodiment, a flow control system is provided for removing liquid from a well having a producing formation. The flow control system includes a pump positioned in a wellbore of the well to remove liquid from the wellbore. A check valve is positioned downhole of the pump and uphole of the producing formation, the check valve having an open position in which gas from the gas-producing formation is allowed to travel uphole and a closed position in which gas from the gas-producing formation is substantially prevented from traveling uphole. A compressor is positioned at a surface of the well. The compressor includes an inlet port and an outlet port. A second valve is fluidly connected between the outlet port of the compressor and the wellbore. The second valve is positionable in a closed position to prevent gas discharged from the compressor from entering the wellbore and an open position to allow gas discharged from the compressor to enter the wellbore. A third valve is fluidly connected between the wellbore and the inlet port of the compressor. The third valve is positionable in a closed position to prevent gas from the wellbore from entering the compressor and an open position to allow gas from the wellbore to enter the compressor.

In another embodiment, a flow control system is provided for removing liquid from a well having a producing formation. A pump is positioned in the well to remove liquid from the well. A check valve is positioned in the well and includes an open position and a closed position. The check valve in the open position allows gas from the producing formation to flow past the check valve, while the check valve in the closed position substantially reduces gas flow at the pump from the producing formation. A compressed gas source is in fluid communication with the well to provide compressed gas to move the check valve to the closed position.

In yet another embodiment, a method for removing liquid from a well having a producing formation is provided. The method includes delivering a compressed gas to the well to close a check valve positioned within the well. A pump is isolated at a downhole location from the producing formation with the closed check valve, and the liquid is pumped from the downhole location while the pump is isolated from the gas formation.

Other objects, features, and advantages of the invention will become apparent with reference to the drawings, detailed description, and claims that follow.

DETAILED DESCRIPTION OF THE ILLUSTRATIVE EMBODIMENTS

In the following detailed description of several illustrative embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

One method to overcome gas interference problems in pumped wells is to temporarily block and isolate the pump from the flow path of production fluids while the pump is in operation. In this cyclic process, accumulated production liquids can be pumped from the well without the interference of gas flowing past the pump inlet. Once the liquids are pumped from the well, the pump is stopped and the sealing mechanism is de-activated, thus allowing production liquids to again accumulate around the pump. Numerous configurations and methods may be used to temporarily restrict the flow of fluids past the pump.

Figure 3:
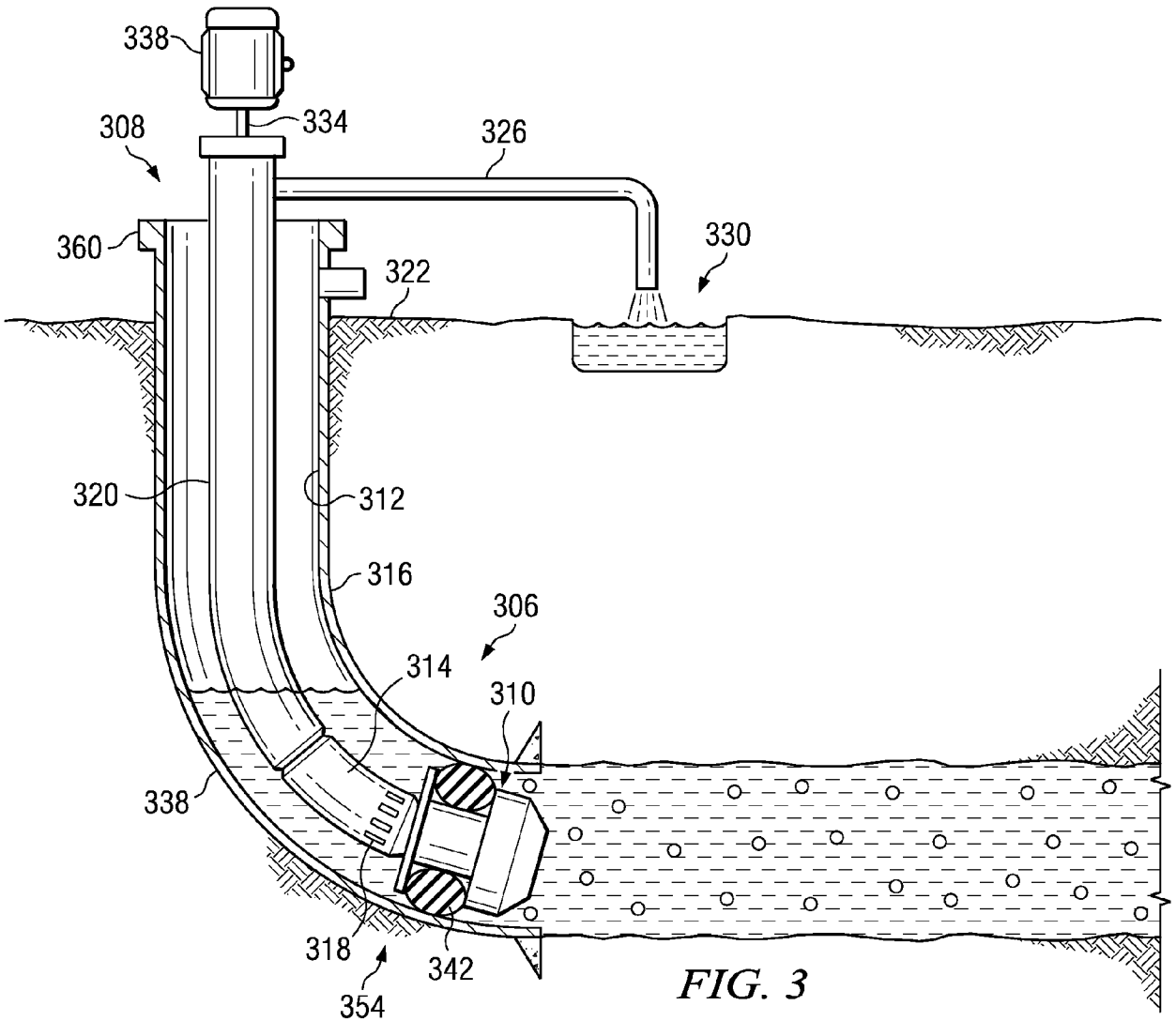
FIG. 3 illustrates a flow control system according to an illustrative embodiment, the flow control system including a progressing cavity pump and a sealing element positioned downhole of the progressing cavity pump.

Referring to FIG. 3, a flow control system 306 according to one embodiment of the present invention is used in a well 308 having at least one substantially horizontal portion. The flow control system 306 includes a downhole sealing unit, or isolation device 310 disposed within a wellbore 312 of the well 308 below (i.e. downhole from) a downhole pump 314. While the wellbore illustrated in FIG. 3 is partially cased with a casing 316, the wellbore 312 could also be uncased and any reference to providing equipment within the wellbore or sealing against the wellbore should be understood as referring to such provision or sealing within a casing, liner, conduit, tubing or open wellbore.

The pump 314 includes inlets 318 and is fluidly connected to a tubing string 320 that extends from a surface 322 of the well 308. The tubing string is fluidly connected to a liquid removal line 326 that leads to a storage reservoir 330. The pump 314 is driven by a drive shaft 334 that extends from the pump 314 to a motor 338 positioned at the surface 322 of the well 308. The motor 338 provides power to the pump 314 to permit pumping of liquid from wellbore 312. The liquid travels from the pump 314, through the tubing string 320 and liquid removal line 326, and into the storage reservoir 330.

The isolation device 310 is capable of being activated during a pumping cycle to isolate the pump 314 from a gas-producing formation or gas source. The sealing unit 310 may include an expandable seal, or sealing element 342 that is formed from an elastomeric material and is capable of expanding against the wellbore 312, thereby providing a barrier between the pump inlets 318 of the pump 314 and the flow of gaseous fluids. The engagement of the sealing element 342 against the wellbore 312 further seals and contains an accumulated column of liquid in the annulus surrounding the pump 314, thereby creating an isolated pump chamber uphole of the sealing element 342. The sealing element 342 is capable of adequately sealing against either a cased or an uncased wellbore 312.

Referring still to FIG. 3, in an illustrative embodiment, pump 314 may be a progressing cavity pump installed in a heel, or low angle, region 354 of a curve 338 of the well 308. The heel region 354 is located proximate the substantially horizontal portion of the well 308. Ideally, the pump inlet 318 may be located at a point in the well 308 where the inclination of the wellbore 312 first begins to change from horizontal to vertical. As an example, a 6¼" diameter horizontal well might utilize a 250' radius curve. For this well configuration, a 3½" diameter progressing cavity pump discharging into 2⅞" tubing would be located at a point in the curve between 85-89 degrees of inclination from vertical.

In an automated pumping system, the start of the pumping cycle may be initiated by an indication of a build-up of liquids in the well. In one embodiment, a down-hole pressure measurement may be taken near pump inlet 318 and then differentially compared to a pressure measurement taken in the casing 316 at a wellhead 360 of the well 308. The differential pressure may be translated into a measurement of the vertical column of liquid above the pump 314. At some desired fluid head set-point, the start of a pumping cycle would begin. Once a wellbore seal is formed, the pump 314 is started, and liquids surrounding the pump 314 are drawn into the pump inlet, and discharged out of the pump 314, through tubing, to the surface. Expanding on the example given previously, if the pump cycle is initiated upon a liquid build-up of 4.5 psi (10 feet of water), the first 75 feet of the 250' radius curve would contain liquid. The annular volume in this area would be 2.1 barrels. A pump rated at 800 barrels per day would remove this liquid in approximately 4 minutes.

An alternative, and perhaps simpler, system of pump automation may involve the use of a timer to initiate the start of the pump cycle. In this configuration, a pump cycle would automatically start a pre-determined amount of time after the end of the previous cycle.

Referring still to FIG. 3, but also to FIGS. 4-7, the first action to occur in a pump cycle is the expansion of the sealing element 342 of the wellbore sealing unit 310 disposed downhole of the progressing cavity pump 314. The sealing unit 310 is activated by an axial movement of a pump rotor 364 of the progressing cavity pump 314. The progressing cavity pump 314 includes a stator 366 in addition to the pump rotor 364. The stator 366 remains stationary relative to a pump housing 370 in which the stator 366 is disposed. The pump rotor 364 is substantially helical in shape and is turned by a motor (not shown) at the surface of the well. As the rotor 364 turns within the stator 366, liquid within the pump housing 370 is pushed through the pump by the helical rotor 364. The progressing cavity pump 314 further includes a plurality of inlets that allow liquid within the wellbore to enter the pump housing 370. The rotor 364 is also capable of axial movement between a disengaged position illustrated in FIG. 4, a first engaged position (not illustrated), and a second engaged position illustrated in FIG. 5.

A transmission housing 368 is threadingly connected to the pump housing 370. This rigid, yet removable connection of the transmission housing 368 to the pump housing 370 permits the transmission housing 368 to remain affixed relative to the stator 366 of the pump 314. The transmission housing 368 houses a transmission assembly 372 that is capable of transmitting axial forces from the rotor 364 to the sealing element 342. The transmission assembly 372 includes a push rod 374 having a receiving end 376 and a bearing end 378. The receiving end 376 of the push rod includes a conically or alternatively shaped recess 380 to receive the rotor 364 when the rotor 364 is placed in and between the first engaged position and the second engaged position. The push rod 374 may be substantially circular in cross-sectional shape and is tapered such that a minimum diameter or width of the tapered portion is approximately midway between the receiving end 376 and the bearing end 378. The tapered shape of the push rod 374 imparts additional flexibility to the push rod 374, which allows the push rod 374 to absorb the eccentric orbital motion of the rotor 364 without damage to the push rod 374 or the other components of the transmission assembly 372.

The bearing end 378 of the push rod 374 includes a pin 382 that is received by a thrust bearing 384. The thrust bearing 384 is constrained within a recess 386 of a transmission sleeve 388 by a bearing cap 390 that is threadingly connected to the transmission sleeve 388. The push rod 374 is secured to the thrust bearing 384 by a nut 391. The thrust bearing 384 permits rotation of the push rod 374 relative to the transmission sleeve 388. The thrust bearing 384 also provides axial support for the push rod 374 as the push rod 374 receives compressive forces imparted by the rotor 364.

The transmission sleeve 388 is positioned partially within and partially outside of the transmission housing 368. The transmission sleeve 388 includes a plurality of extension elements 392 circumferentially positioned about a longitudinal axis of the transmission sleeve 388. The extension elements 392 pass through slots 394 in the transmission housing 368 and engage a thrust plate 396. The slots 394 constrain the extension elements 392 such that the transmission sleeve 388 is substantially prevented from rotating within the transmission housing 368 but is capable of axial movement. The ability of the transmission sleeve 388 to axially move allows the transmission sleeve 388 to transmit forces received from the push rod 374 to the thrust plate 396.

The thrust plate 396 is one of a pair of compression members, the other compression member being an end plate 398. In the embodiment illustrated in FIGS. 4-7, the transmission housing 368 includes a pin 400 that extends from the transmission housing 368 on an end of the transmission housing 368 that includes the slots 394. The pin 400 passes through the thrust plate 396 and the sealing element 342, each of which are substantially ring shaped and include a central passage. The thrust plate 396 and sealing element 342 are thus carried upon the pin 400 and permitted to move axially along the pin 400 depending on the positioning of the push rod 374 and transmission sleeve 388. The end plate 398 is threadingly received on the pin 400, which affixes the end plate 398 relative to the transmission housing 368. In one embodiment, a tail joint 404 may be threadingly attached to an open end of the end plate 398.

Figure 4:
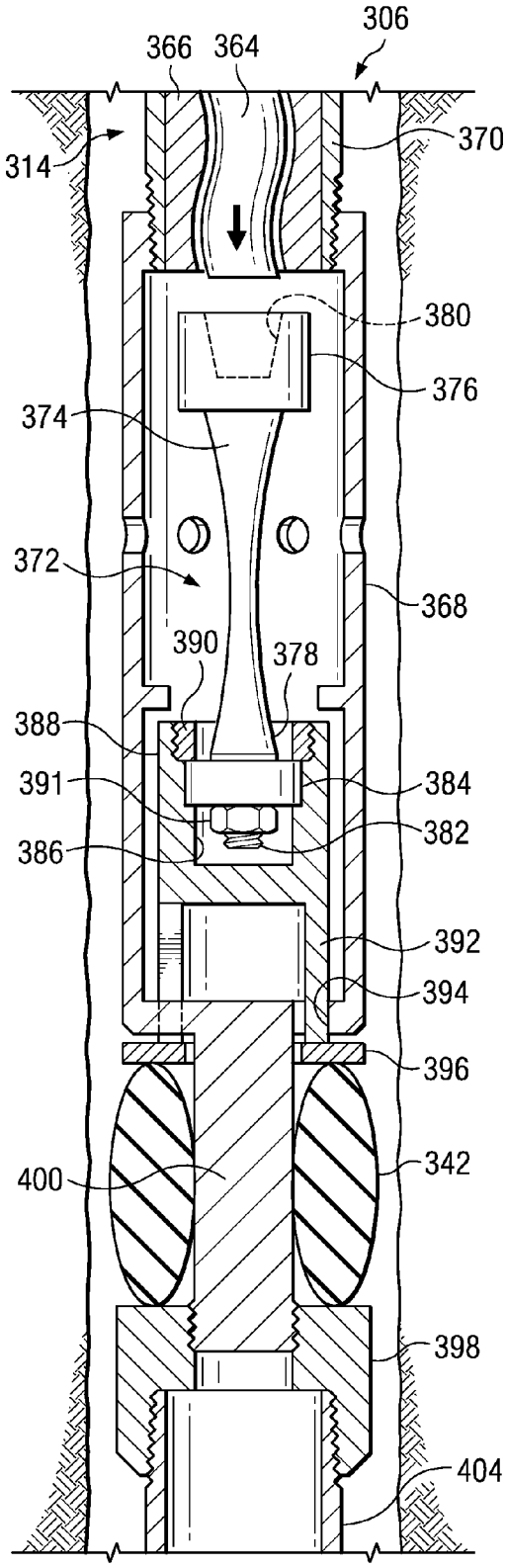
FIG. 4 illustrates a cross-sectional view of the flow control system of FIG. 3, the sealing element being shown in an unsealed position.
Figure 5:
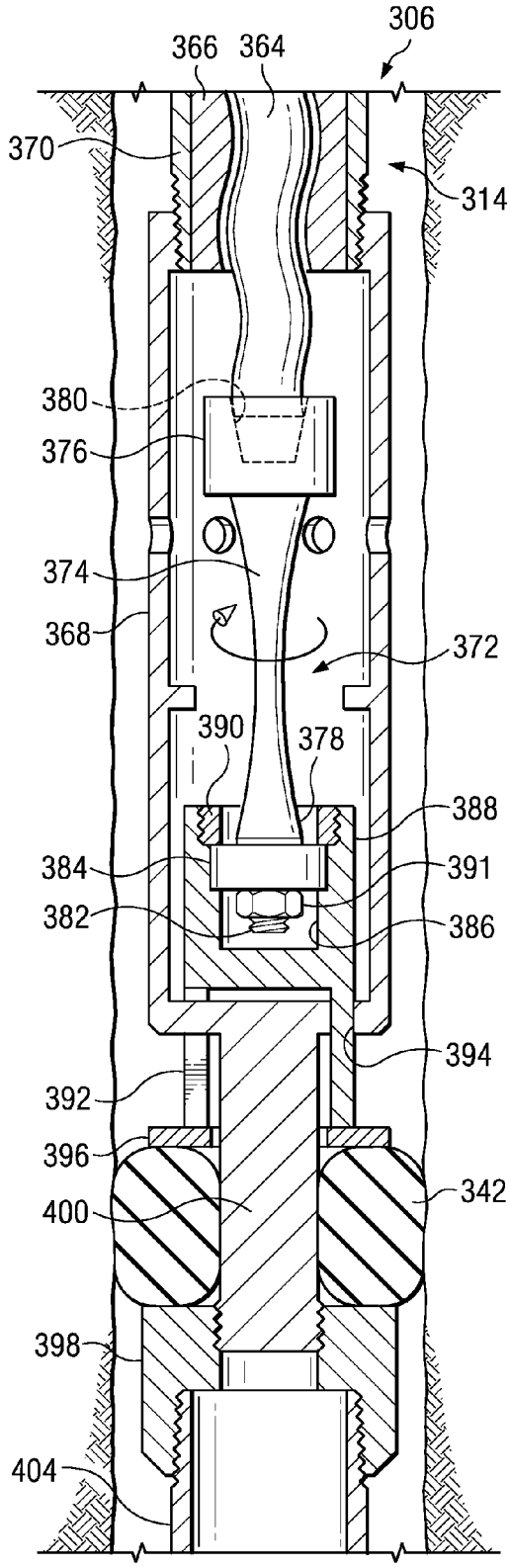
FIG. 5 depicts a cross-sectional view of the flow control system of FIG. 3, the sealing element being shown in a sealed position.
Figure 6:
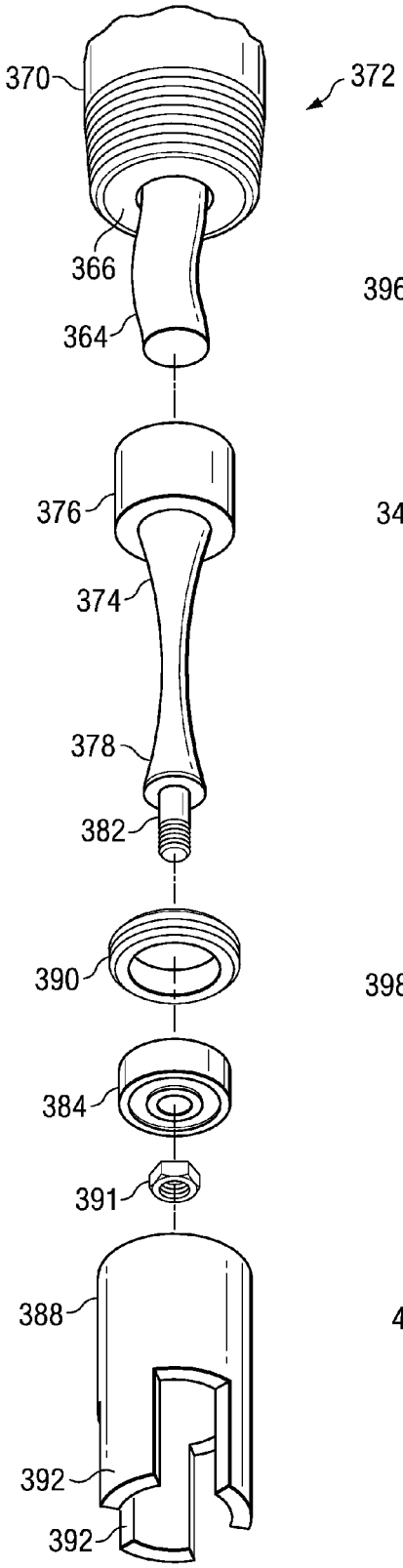
FIG. 6 illustrates an exploded view of a transmission assembly used to link the progressing cavity pump of FIG. 3 with the sealing element.
Figure 7:
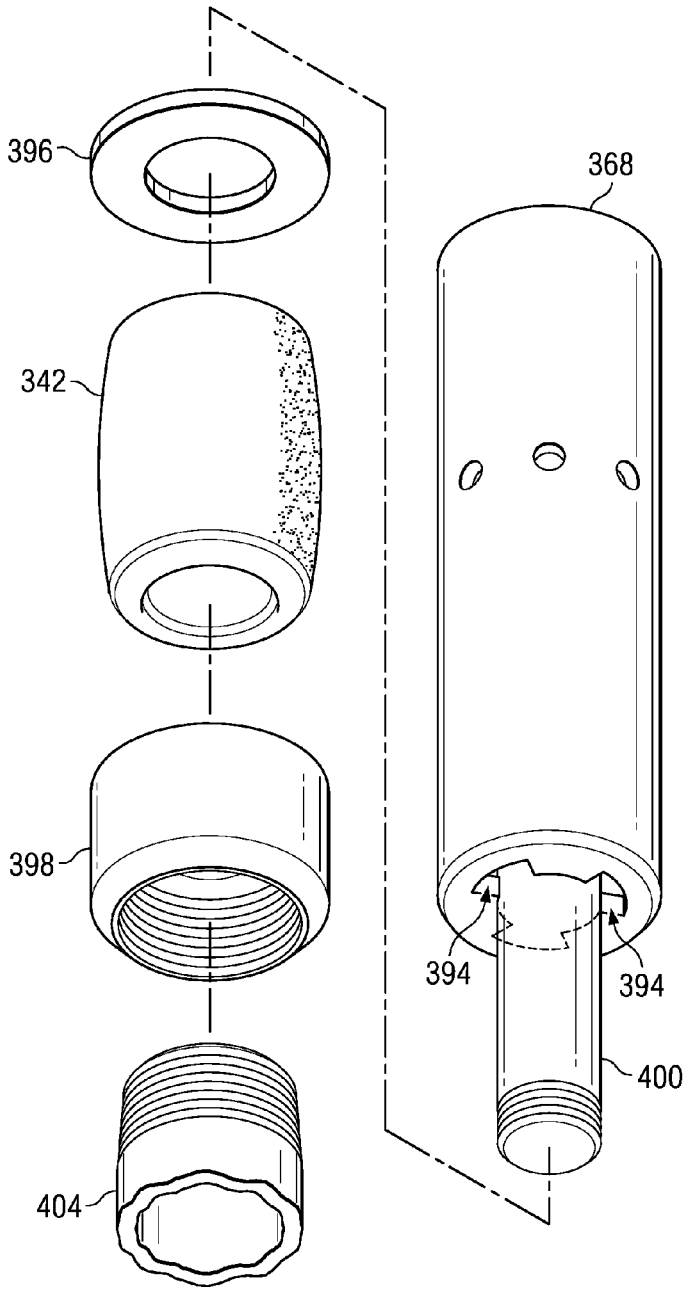
FIG. 7 depicts an exploded view of the sealing element of FIG. 3.

In operation, the sealing element 342 is positioned in an unsealed position when the rotor 364 is in the disengaged position illustrated in FIG. 4. When it is desired to place the sealing element 342 in a sealed position, thereby substantially preventing fluid flow past the sealing element 342, the rotor 364 is axially moved to the first engaged position (not illustrated). In the first engaged position, the rotor 364 contacts and engages the push rod 374, but the sealing element 342 remains in the unsealed position. As the rotor 364 is axially advanced into the second engaged position illustrated in FIG. 5, the sealing element 342 moves into the sealed position. More specifically, as the rotor 364 is axially moved into the second engaged position, the rotor 364 imparts an axial force on the push rod 374, which is transmitted to the transmission sleeve 388. The axial force is similarly transmitted by the extension elements 392 of the transmission sleeve 388 to the thrust plate 396. The axial force against the thrust plate 396 causes the thrust plate 396 to travel along the pin 400, which compresses the sealing element 342 between the thrust plate 396 and the end plate 398. This compression results in the sealing element 342 expanding radially, which seals the sealing element 342 against the wellbore 312.

The rotor 364 may also rotate during the engagement operations described above. While it is typically desired that the pump 314 be operated after movement of the sealing element 342 to the sealed position, it may alternatively be desired to begin pumping operations just prior to axially moving the rotor 364 into the first or second engaged positions. In some circumstances, rotation of the rotor 364 during engagement operations may assist in seating the rotor within the recess 380 of the push rod 364. Regardless, the configuration of the transmission assembly 372 allows continued rotation of the rotor 364 during axial movement and force transmission.

Figure 8:
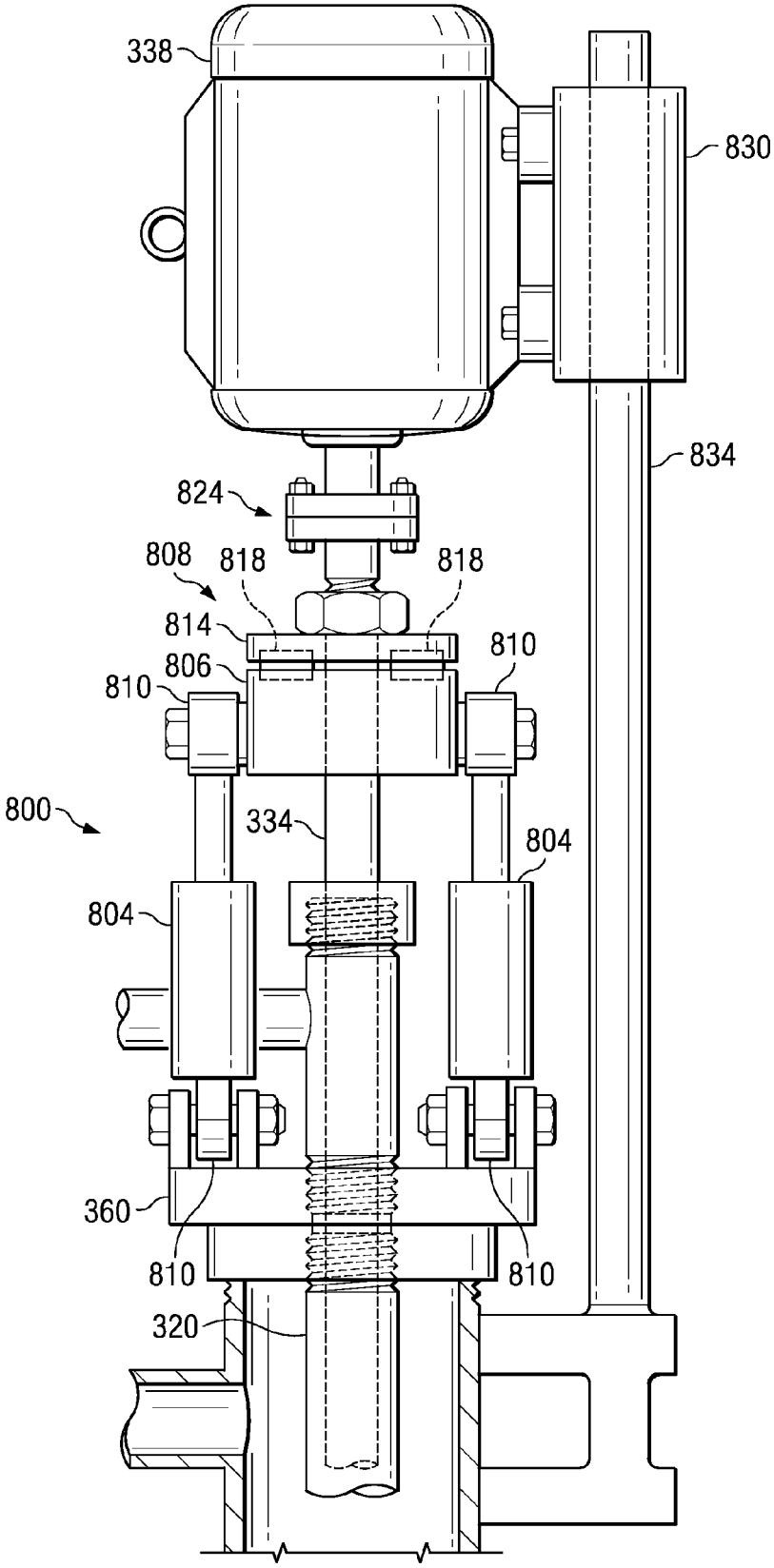
FIG. 8 illustrates a flow control system according to an illustrative embodiment, the flow control system including a motor and a lift system positioned at a surface of a well for rotating, lifting, and lowering a drive shaft extending into the well.

Referring still to FIGS. 4-7, but also to FIG. 8, the forces imparted to the rotor 364, both rotational and axial, are delivered by equipment at the surface 322 of the well 308. To accomplish this, a lift system 800, attached to the wellhead 360, is provided to raise and lower the drive shaft 334, which is connected downhole to the rotor 364. The use of the term "drive shaft" is not meant to be limiting and may refer to a single component or a plurality of hollow or solid sections formed from tubing or pipe or other material of any cross-sectional shape. While the draft shafts described herein are typically drive, the type of driving force imparted to the draft shaft is not to be limited. For example, the drive shaft may be rotated and/or axially driven or reciprocated. In one embodiment, the drive shaft 334 is positioned within the tubing string 320, which is fluidly connected to an outlet of the pump 314. the tubing string 320 is used to channel liquid to the surface 322 of the well 308 during pumping operations. As described previously, the motor 338 is operably connected to the drive shaft 334 to transmit rotational motion to the rotor 364. By delivering both axial and rotational forces to downhole equipment through a single drive shaft, significant savings are realized, both in terms of space within the wellbore 312 and material cost.

Referring still to FIG. 8, the lift system 800 may be a hydraulic lift that includes a pair of hydraulic cylinders 804, each of which is connected at a first end to the wellhead 360 and at a second end to a lower bearing plate 806 of a bearing block 808. Preferably, the connections at each end of the hydraulic cylinders 804 are pinned connections 810, which allow some pivotal movement of the hydraulic cylinders 804 to compensate for some of the forces imparted by the weight of the drive shaft 334.

In addition to the lower bearing plate 806, the bearing block 808 includes an upper bearing plate 814 affixed to the drive shaft 334. Bearing members 818 are positioned between the upper and lower bearing plates 814, 806 to provide support between the bearing plates and to allow rotation of the upper bearing plate 814 relative to the lower bearing plate 806. Bearing members 818 may include ball bearings, roller bearings, or any other type of suitable device that provides rotational and axial bearing support. In one configuration, the motor 338 is connected to the drive shaft 334 through a direct drive connection 824. Alternatively, a speed reducer may be installed between the motor 338 and the drive shaft 334. Since the motor 338 is directly connected to the drive shaft 334 and bearing block 812, the motor 338 moves with the drive shaft 334 as the drive shaft is lifted and lowered by the hydraulic lift system 800. A sleeve 830 mounted to the motor 338 receives a guide post 834 affixed to the wellhead 360 to resist reactive torque and to stabilize and guide the motor 338 as the motor 338 moves in response to movement of the hydraulic cylinders 804.

In an alternate configuration, the wellhead-mounted lift system 800 may be eliminated when the natural stretch of the rods, caused when transmitting torque to the rotor of the progressing cavity pump, is sufficient to extend the pump rotor 344 below the pump inlet 326 and engage the push rod assembly 364.

Figure 9:
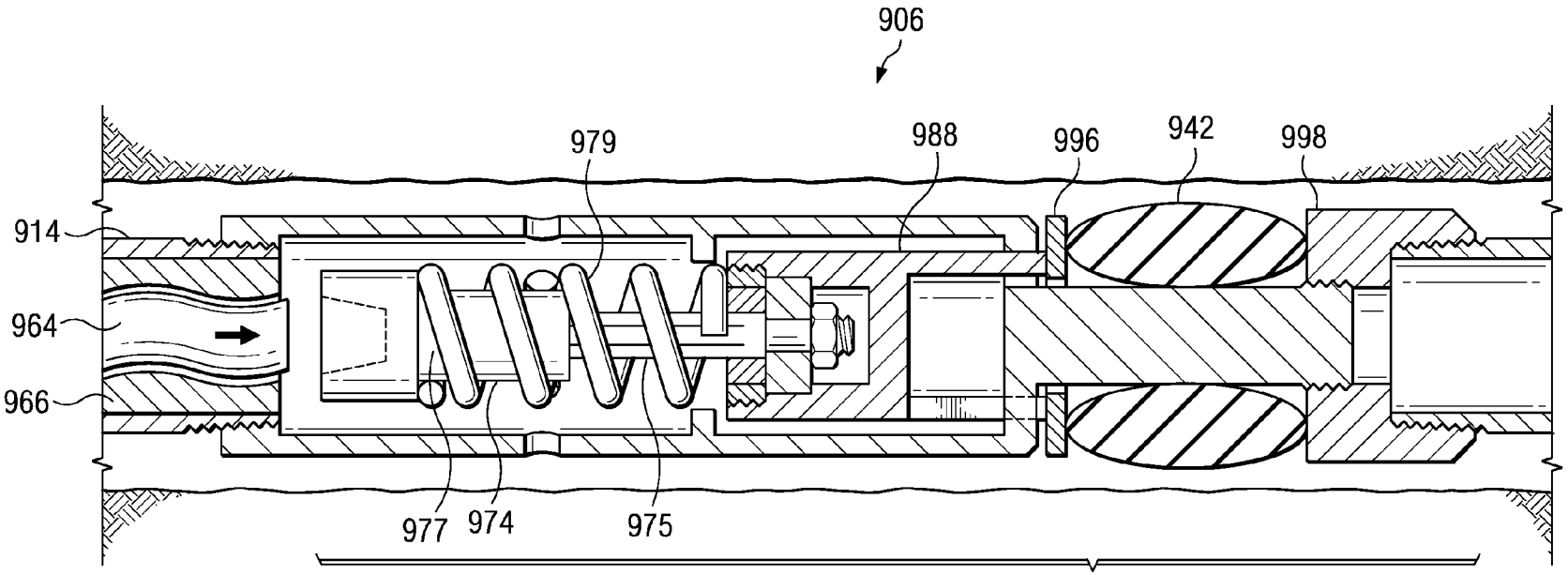
FIG. 9 illustrates a cross-sectional view of a flow control system according to an illustrative embodiment, the flow control system including a progressing cavity pump and a sealing element shown in an unsealed position.

Referring to FIG. 9, in another embodiment, a flow control system 906 includes an isolation device 910 and a progressing cavity pump 914. The progressing cavity pump 914 is substantially the same as the progressing cavity pump 314 described with reference with FIGS. 3-7. The progressing cavity pump 914 includes a rotor 964 that is rotatingly received by a stator 966. The stator 966 remains stationary relative to a pump housing in which the stator 966 is disposed. The pump rotor 964 is substantially helical in shape and is turned by a motor (not shown) at the surface of the well. As the rotor 964 turns within the stator 966, liquid within the pump housing is pushed through the pump by the helical rotor 964. The progressing cavity pump 914 further includes a plurality of inlets that allow liquid within the wellbore to enter the pump housing.

The isolation device 910 is similar in operation and structure to isolation device 310. The isolation device 910 includes a push rod 974, a transmission sleeve 988, a thrust plate 996, a sealing element 942, and an end plate 998. The primary difference between flow control system 906 and flow control system 306 is the difference between push rod 974 and 374.

Push rod 974 accommodates axial movement of the pump rotor 964 beyond the point that causes the elastomeric sealing element 942 to fully expand against the wall of the wellbore. This configuration would be useful in allowing more tolerance in the positioning of the rotor 964 within the pump 914. In this embodiment, the push rod assembly 974 may include a splined shaft 975 received within a splined tube 977. The splined shaft and splined tube having interlocking splines to prevent rotational movement of the splined shaft relative to the splined tube. The splined shaft and splined tube are capable of relative axial movement between an extended position and a compressed position.

A spring 979 is operably associated with the splined shaft and splined tube to bias the splined shaft 975 and splined tube 977 into the extended position. The spring constant of the sealing element 942 is preferably less than the spring constant of the spring 979 such that an axial force delivered to the push rod 974 first compresses the sealing element 942 and then compresses the spring 979 after the sealing element 942 has formed the seal.

Activation of the sealing element 942 is accomplished by lowering the rotor 964 through the pump 914 such that the rotor 964 engages the receiver end of the push rod 974. This axial movement is first primarily translated into compression of the sealing element 942, since the sealing element is designed with a lower spring constant (i.e. k-factor) than that of the spring 979. When the sealing element 942 is fully compressed into the sealed position and the transmission sleeve 988 has reached the limit of travel, the splined shaft 975 and the splined tube 977 will then continue to compress to accept further axial movement of the rotor 964.

In any of the embodiments disclosed with reference to FIGS. 3-9, the bearing assembly used to support the push rod may alternatively be located within, or proximate to, the receiver end of the push rod. Configured as such, the elongated section of the push rod would be rigidly attached to the transmission sleeve. The flexible shaft of the push rod would accommodate the eccentric orbital path of the rotor while the receiver head bearing assembly would accept the rotor rotation.

In yet another configuration, a double bearing assembly may be deployed at the receiver end of the push rod assembly such that the first bearing rotated concentric with the rotation of the rotor and the second bearing rotated concentric with the orbit of the rotor. In this configuration, the elongated section of the push rod would neither rotate nor wobble about the concentric axis of the housing.

Figure 10:
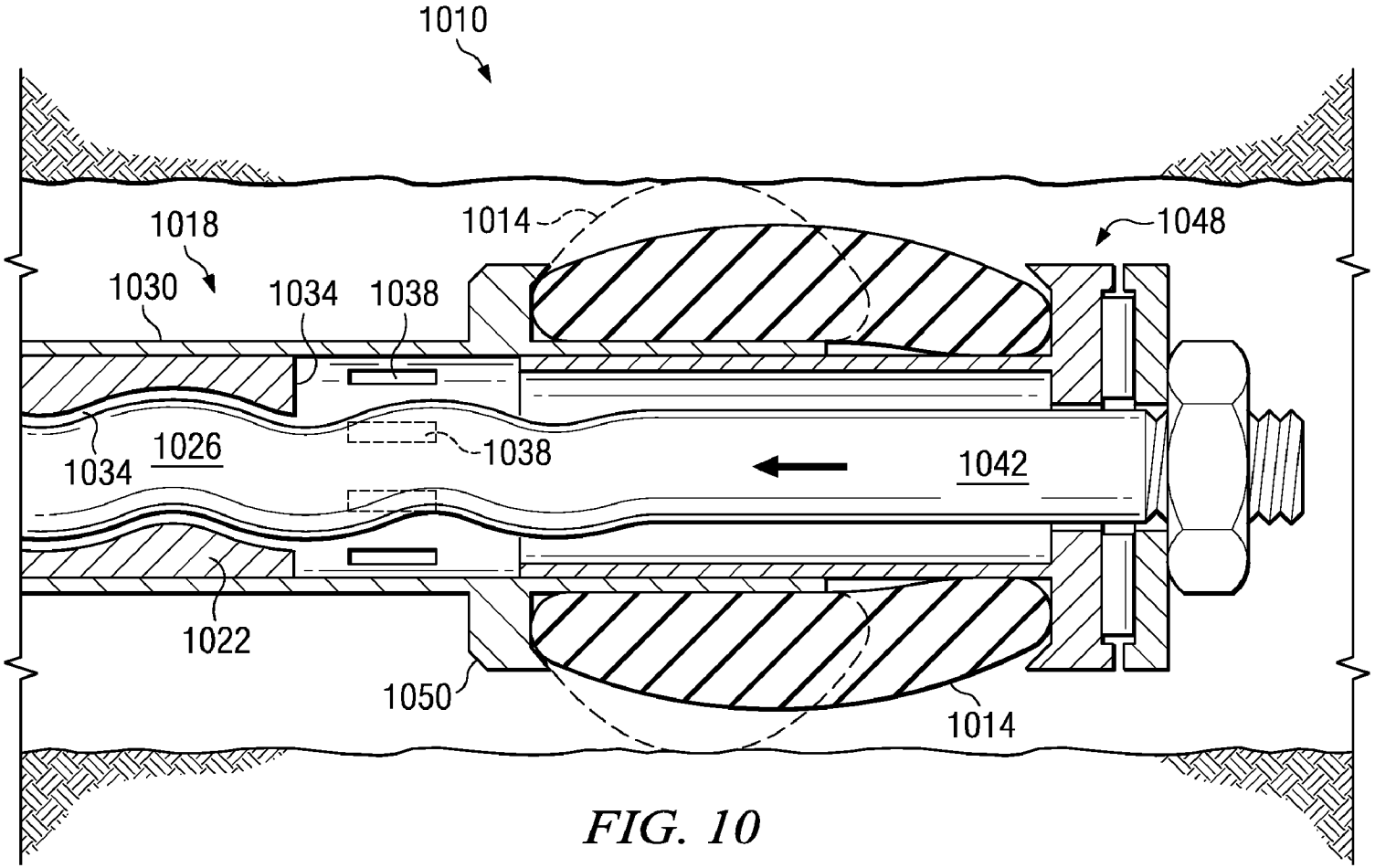
FIG. 10 depicts a cross-sectional view of a flow control system according to an illustrative embodiment, the flow control system including a progressing cavity pump and a sealing element shown in an unsealed position.

Referring to FIG. 10, a flow control system 1010 according to an illustrative embodiment includes a sealing element 1014 that is capable of being expanded against the wall of a wellbore to prevent gas flow from interfering with the operation of a pump 1018. In this particular embodiment, the pump 1018 is a progressing cavity pump that includes a stator 1022 and a rotor 1026. The stator 1022 remains stationary relative to a pump housing 1030 in which the stator 1022 is disposed. The rotor 1026 is substantially helical in shape and is turned by a motor (not shown) at the surface of the well. As the rotor 1026 turns within the stator 1022, liquid within the pump housing 1030 is pushed through the pump by the helical rotor 1026. The pump 1018 further includes a plurality of inlets 1038 that allow liquid within the wellbore to enter the pump housing 1030.

The rotor 1026 is used to actuate the sealing element 1014 so that gas flow in the region of the inlets 1038 is blocked during operation of the pump 1018. The rotor 1026 includes an extended shaft 1042 that is connected to a thrust plate 1048 that is capable of being axially moved relative to the pump housing 1030. Applying an engaging force to the extended shaft 1042 compresses the sealing element 1014 between the thrust plate 1048 and an end plate 1050 positioned on an opposite end of the sealing element 1014. The axial compression of the sealing element 1014 causes the sealing element 1014 to radially expand against the wall of the wellbore and into the sealed position. This operation may be reversed by moving the thrust plate 1048 in the opposite direction. Selective engagement and disengagement of the sealing element 1014 against the wall of the wellbore may be controlled from the surface of the well.

The primary difference between flow control system 1010 and the previously described systems 306, 906 is that the flow control system 1010 involves placing the rotor 1026 in tension to actuate the sealing element 1014. Both systems 306 and 906 involved placing the rotor in compression to actuate a sealing element.

Figure 1:
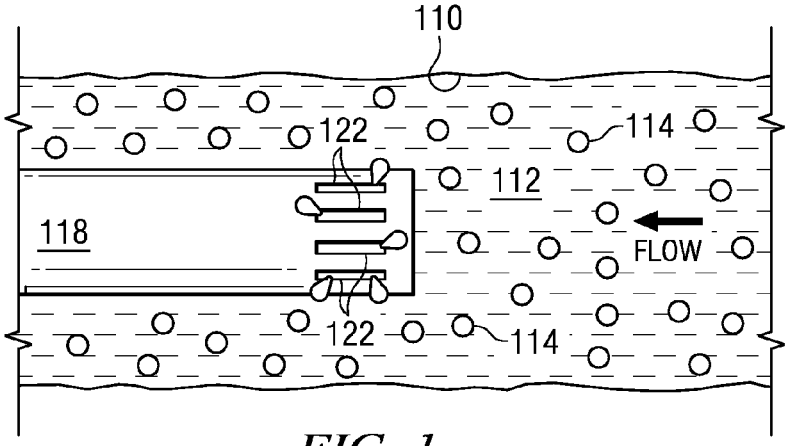
FIG. 1 illustrates a schematic of a downhole pump positioned in a wellbore in which a liquid and gas are present in a region of the downhole pump.
Figure 11:
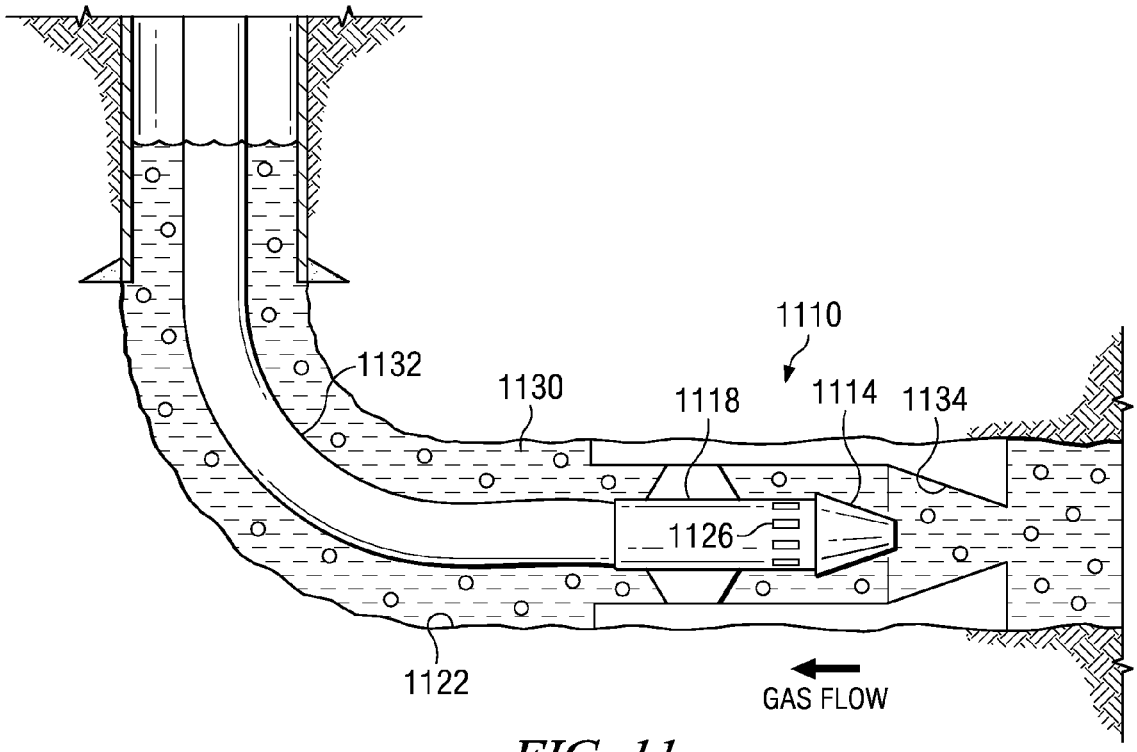
FIG. 11 illustrates a flow control system according to an illustrative embodiment, the flow control system having a valve body and valve seat capable of being engaged to prevent gas flow near a pump, the flow control system being shown in a disengaged position prior to liquid removal.
Figure 2:
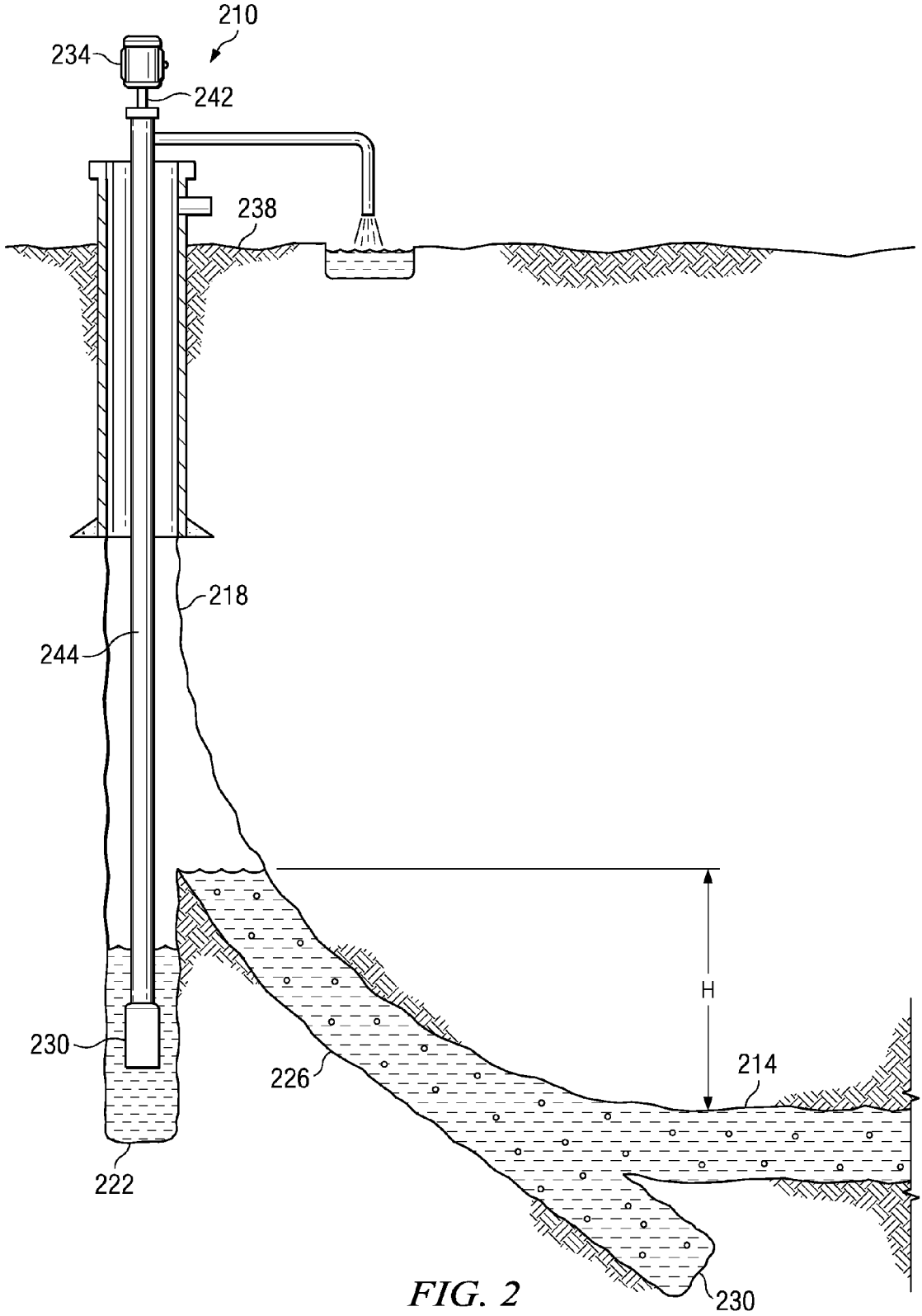
FIG. 2 depicts a well having a substantially vertical component, a substantially horizontal component, and a sump positioned along a curve between the substantially horizontal and vertical portions.
Figure 12:
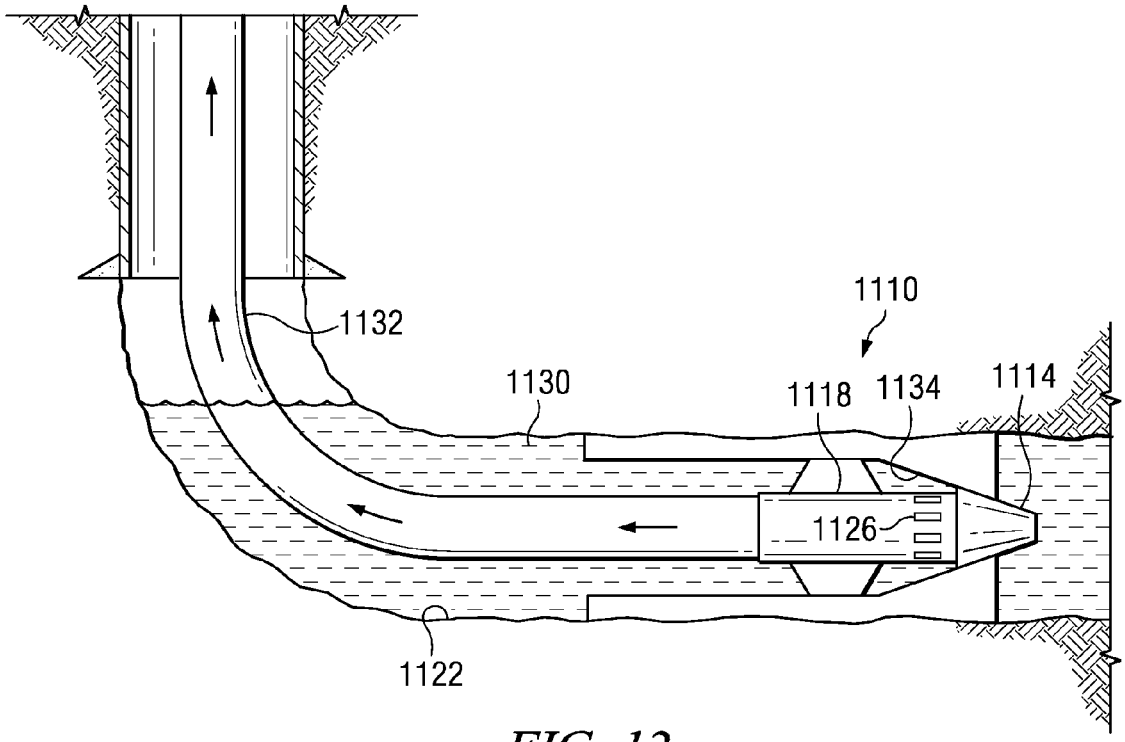
FIG. 12 illustrates the flow control system of FIG. 11, the flow control system being shown in an engaged position during liquid removal.
Figure 13:
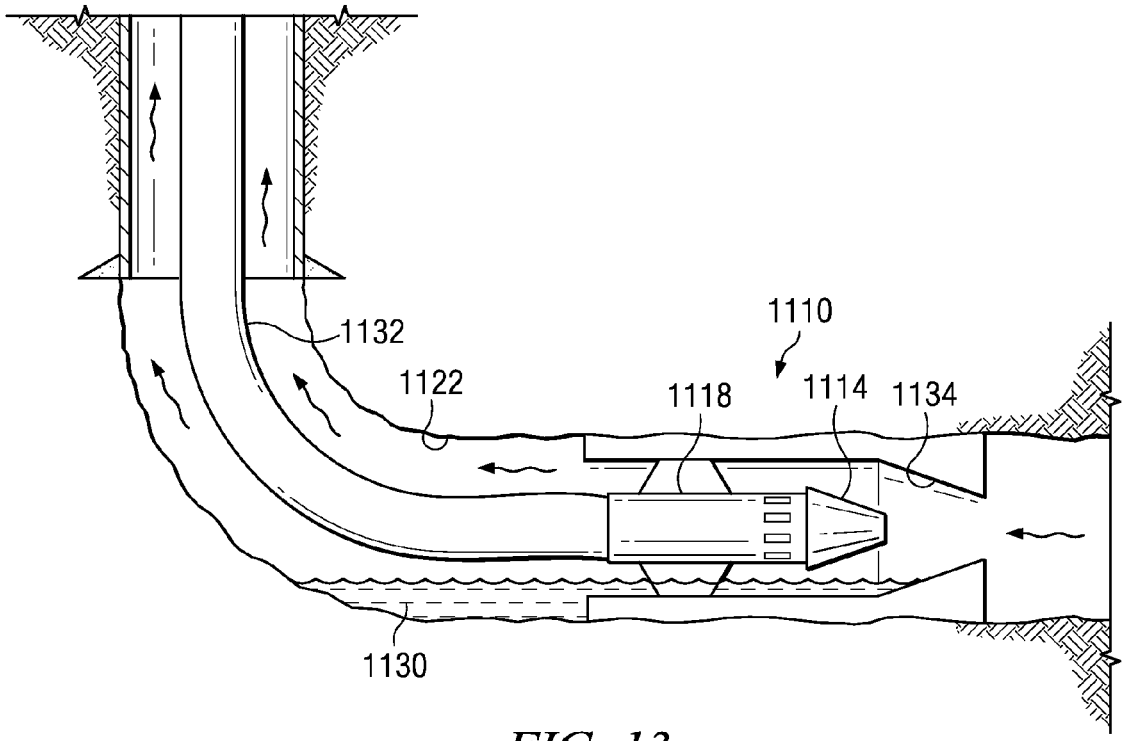
FIG. 13 illustrates the flow control system of FIG. 11, the flow control system being shown in the disengaged position following liquid removal.

Referring to FIGS. 11-13, a flow control system 1110 according to an illustrative embodiment includes a valve body 1114 operably associated and/or integrated with a pump 1118 positioned in a substantially horizontal region of a wellbore 1122. The pump 1118 includes a plurality of inlets 1126 to receive liquid 1130 that is present in the wellbore 1122. The pump 1118 is fluidly connected to a tubing string 1132 such that liquid 1130 may be pumped from the wellbore 1122 to the surface of the well. A valve seat 1134 is positioned downhole of the pump 1118, i.e. upstream of the pump relative to the flow of production fluids. The flow of gas within the region of the pump inlets 1126 can be selectively blocked by moving the valve body 1114 into engagement with the valve seat 1134 (see FIG. 12). When the valve body 1114 and valve seat 1134 are engaged, gas flow is blocked upstream of the pump 1118, which allows efficient removal of the liquid that has collected in the wellbore downstream of and around the pump 1118. When a sufficient amount of liquid 1130 is removed from the wellbore 1122, the valve body 1114 may be moved out of engagement with the valve seat 1134 to reestablish gas flow and production (see FIG. 13). Selective engagement and disengagement of the valve body 1114 and valve seat 1134 may be controlled from the surface of the well by moving the tubing string 1132 connected to the pump 1118, or by any other mechanical or electrical means.

Figure 8A:
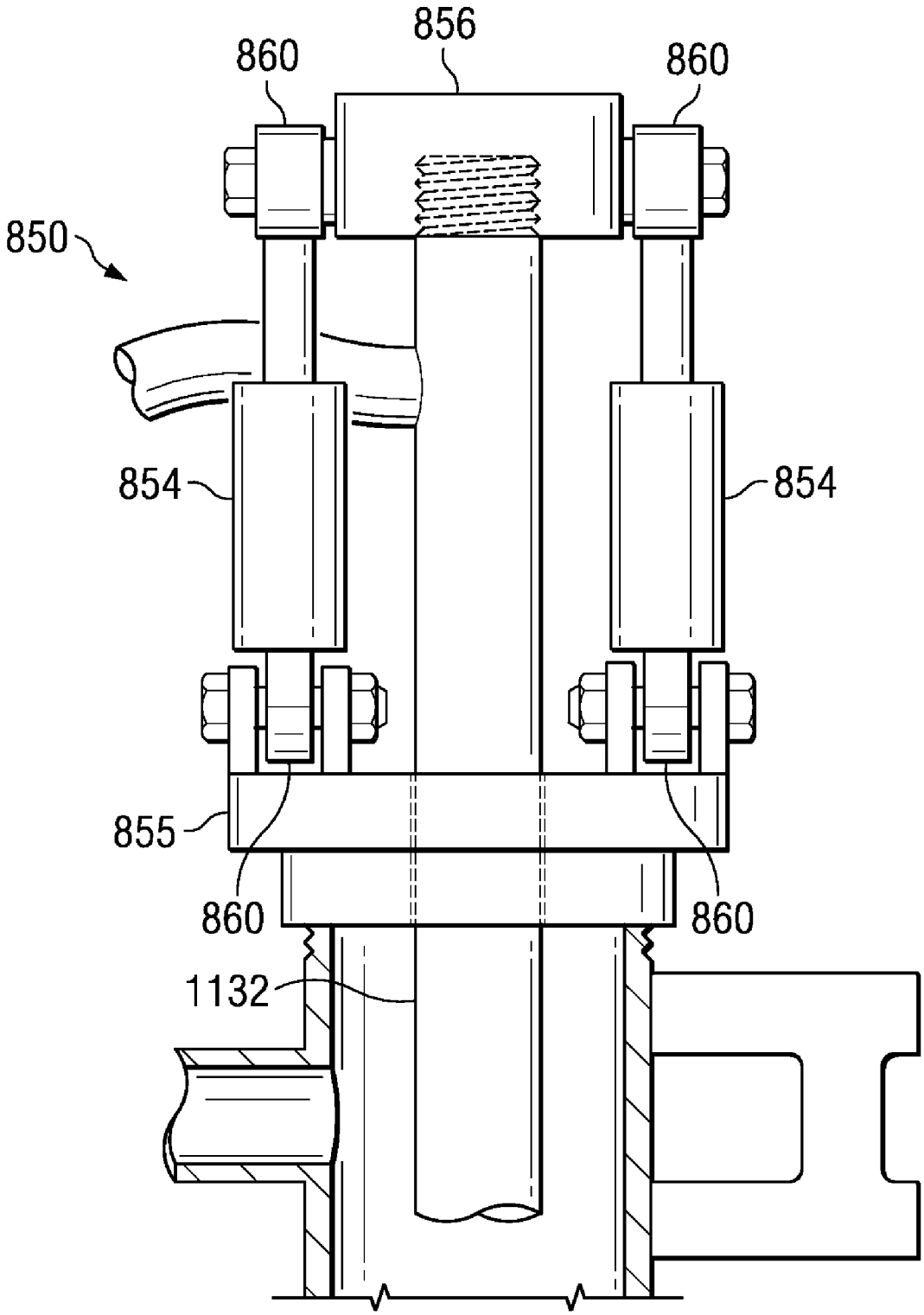
FIG. 8A depicts a flow control system according to an illustrative embodiment, the flow control system including a lift system positioned at a surface of a well for lifting and lowering a tubing string extending into the well.

Referring still to FIGS. 11-13, but also to FIG. 8A, in one embodiment, the engagement and disengagement of the valve body 1114 and the valve seat 1134 may be accomplished using a lift system 850. The lift system 850 may be a hydraulic lift that includes a pair of hydraulic cylinders 854, each of which is connected at a first end to a wellhead 855 and at a second end to a lift block 856. Preferably, the connections at each end of the hydraulic cylinders 854 are pinned connections 860, which allow some pivotal movement of the hydraulic cylinders 854 to compensate for some of the forces imparted by the weight of the tubing string 1132.

While the lift system 800, 850 have been described as being hydraulically driven, the lift system may alternatively be pneumatically driven, or mechanically driven such as for example by a motor or engine that is connected to the tubing string 1132 by direct drive components or some other type of power transmission.

While the valve actuating system has been described as including a lift system to impart axial movement, alternate downhole valve arrangements may also be employed. For example, a rotary valve mechanism can be configured such that a rotational torque applied to the pump tubing at the surface causes a downhole valve to cycle between an open and a closed position.

Figure 14:
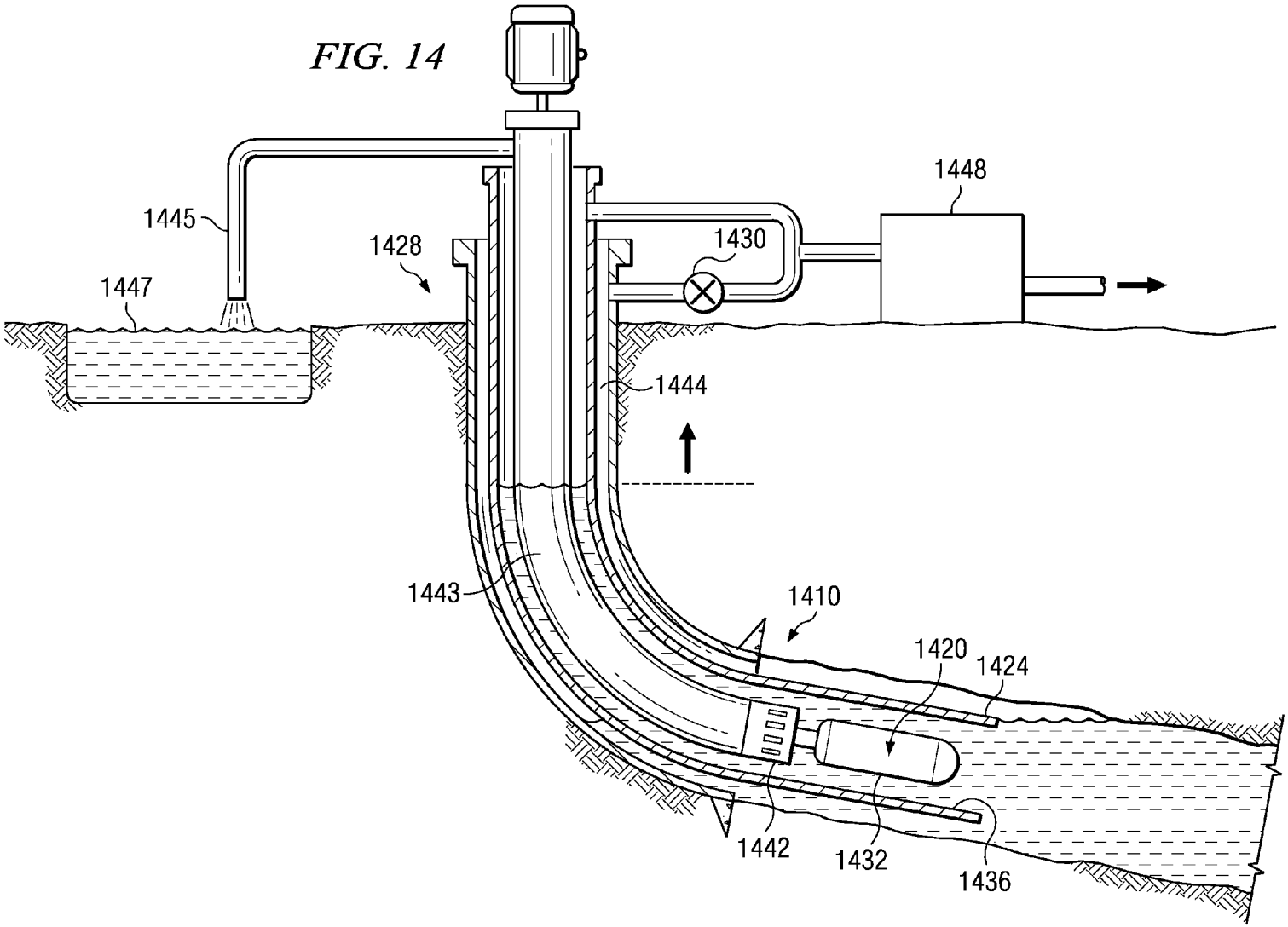
FIG. 14 depicts a flow control system according to an illustrative embodiment, the flow control system having a first tubing string positioned in a well, a second tubing string positioned in the first tubing string, a pump in communication with the second tubing string, and an isolation device to isolate the pump within the first tubing string, the isolation device being shown in an unsealed position prior to liquid removal.
Figure 15:
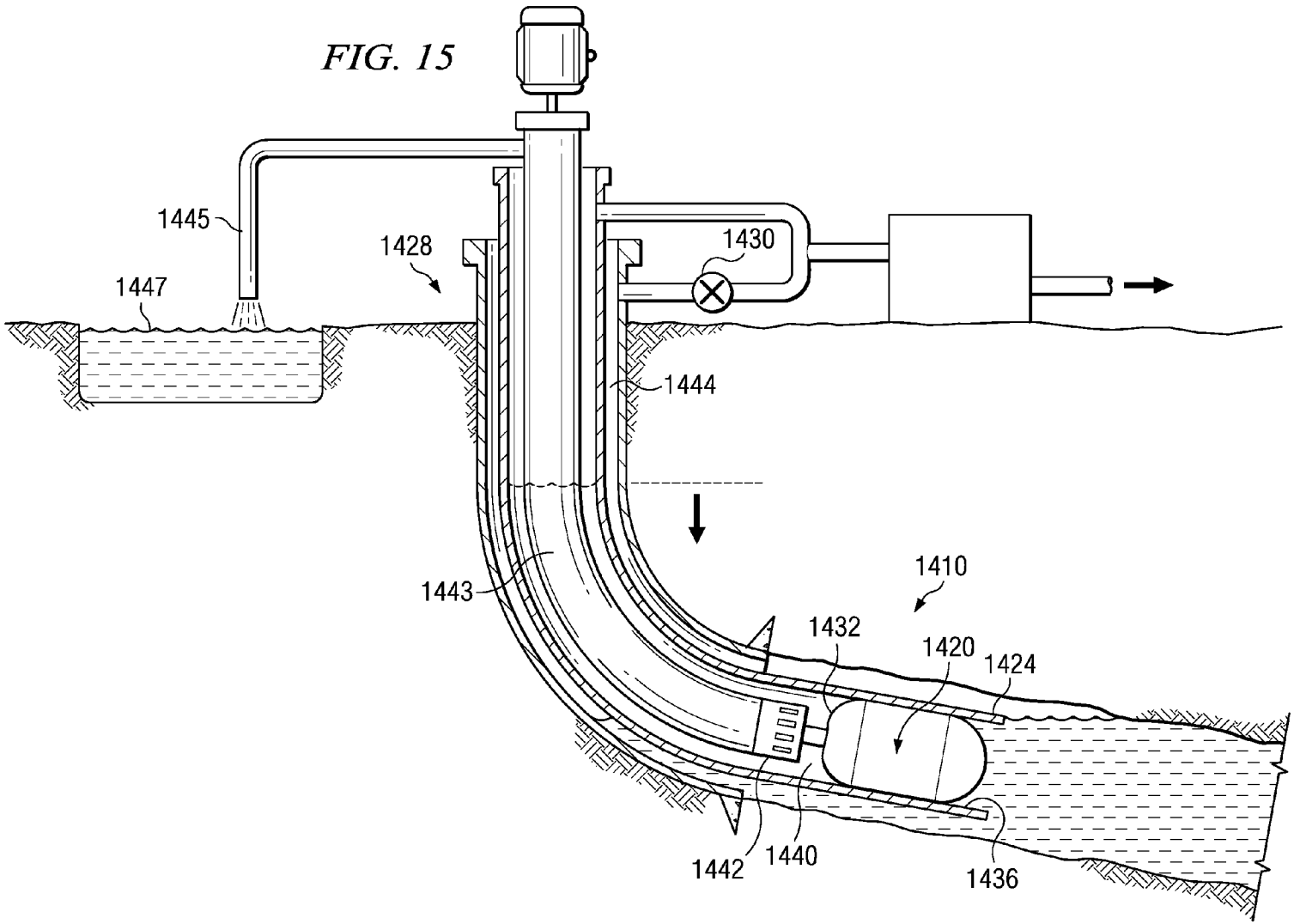
FIG. 15 illustrates the flow control system of FIG. 14 with the isolation device being shown in a sealed position during liquid removal.
Figure 16:
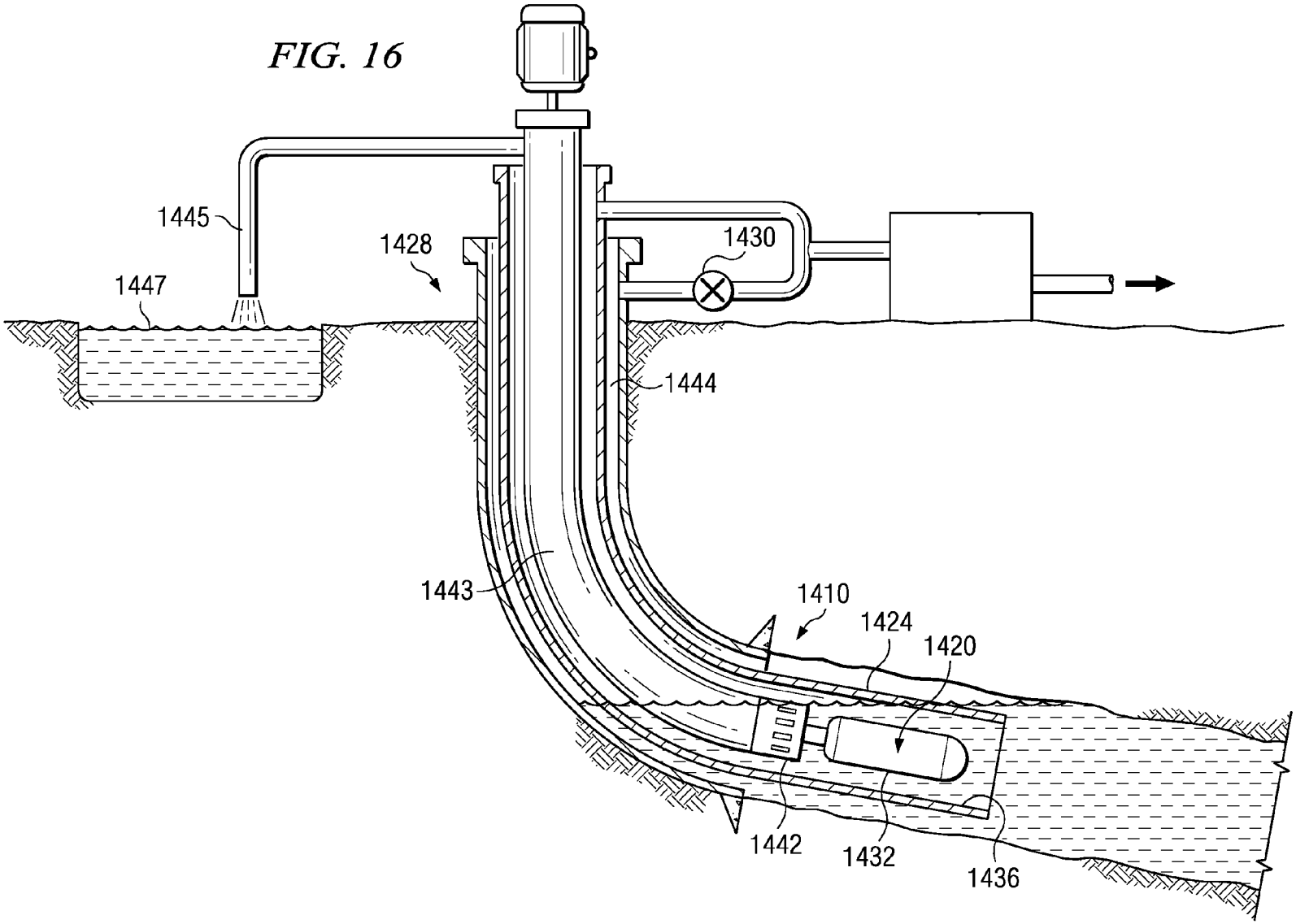
FIG. 16 depicts the flow control system of FIG. 14 with the isolation device being shown in an unsealed position after liquid removal.

Referring to FIGS. 14-16, in another illustrative embodiment, a flow control system 1410 includes a sealing unit, or isolation device 1420 that is deployed within a separate tubing string 1424 installed within a well 1428. The isolation device 1420 may include an expandable sealing element 1432 or any other sealing mechanism that forms an isolated pump chamber 1440 for a pump 1442 (see FIG. 15). The pump 1442 pumps liquid through a tubing string 1443 to a liquid removal line 1445 that leads to a storage reservoir 1447.

An annulus valve 1430 is fluidly connected to a wellbore annulus 1444. Prior to expanding the sealing element 1432, the valve 1430 may be closed to preferentially raise the level of the liquid in the pump chamber 1440. After isolating the pump 1442 by expanding the sealing element 1432, the valve 1430 may be opened such that gas continues to flow through the wellbore annulus 1444 during the pumping cycle, and no additional pressure is exerted against the formation.

When the fluid level has been pumped down to the inlet level of the pump 1442 (see FIG. 16), a pump-off control scheme may be utilized to signal the end of the pump cycle. Numerous such control schemes are available for use. One embodiment uses a flow monitoring device that shuts off the power to the pump drive motor upon detecting a drop in the volume rate of liquid flow at the wellhead. When the pump 1442 is stopped, the wellhead hydraulic lift system raises the drive shaft and pump rotor, thus disengaging the sealing element 1432, and once again allowing wellbore fluids to flow past the pump 1442.

When the sealing element 1432 is in an expanded position, gas is produced through the wellbore annulus 1444 and may be further pressurized at the surface of the well 1428 by a compressor 1448. When the sealing element 1432 is disengaged, gas is produced through either or both of the wellbore annulus 1444 and the tubing string 1424.

An alternative configuration (not shown) of the isolation device 1420 may include an inflatable packer, a similar elastomeric pack-off device, or any other valve device.

Figure 17:
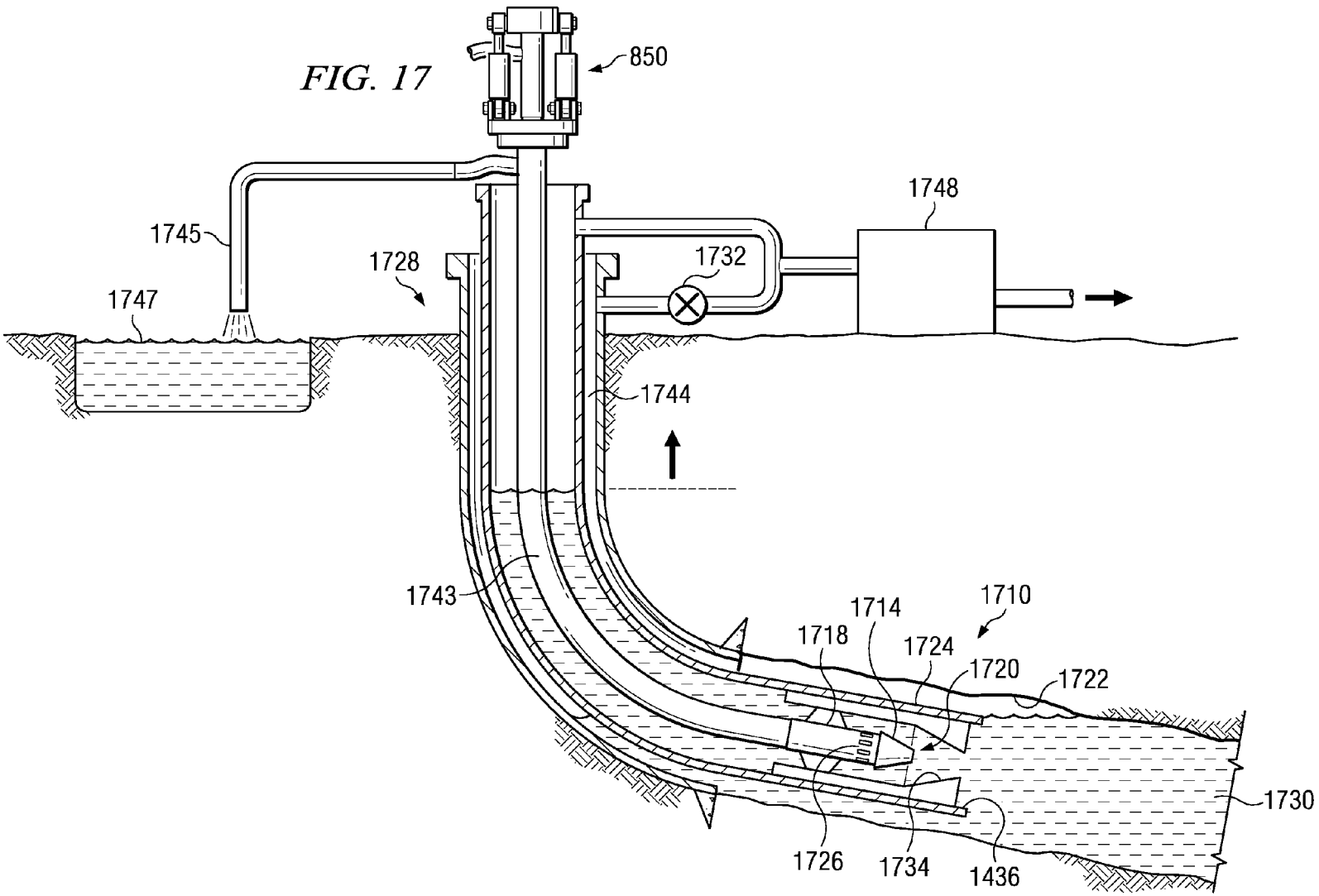
FIG. 17 illustrates a flow control system according to an illustrative embodiment, the flow control system having a first tubing string positioned in a well, a second tubing string positioned in the first tubing string, a pump in communication with the second tubing string, and an isolation device to isolate the pump within the first tubing string, the isolation device being shown in an unsealed position prior to liquid removal.
Figure 18:
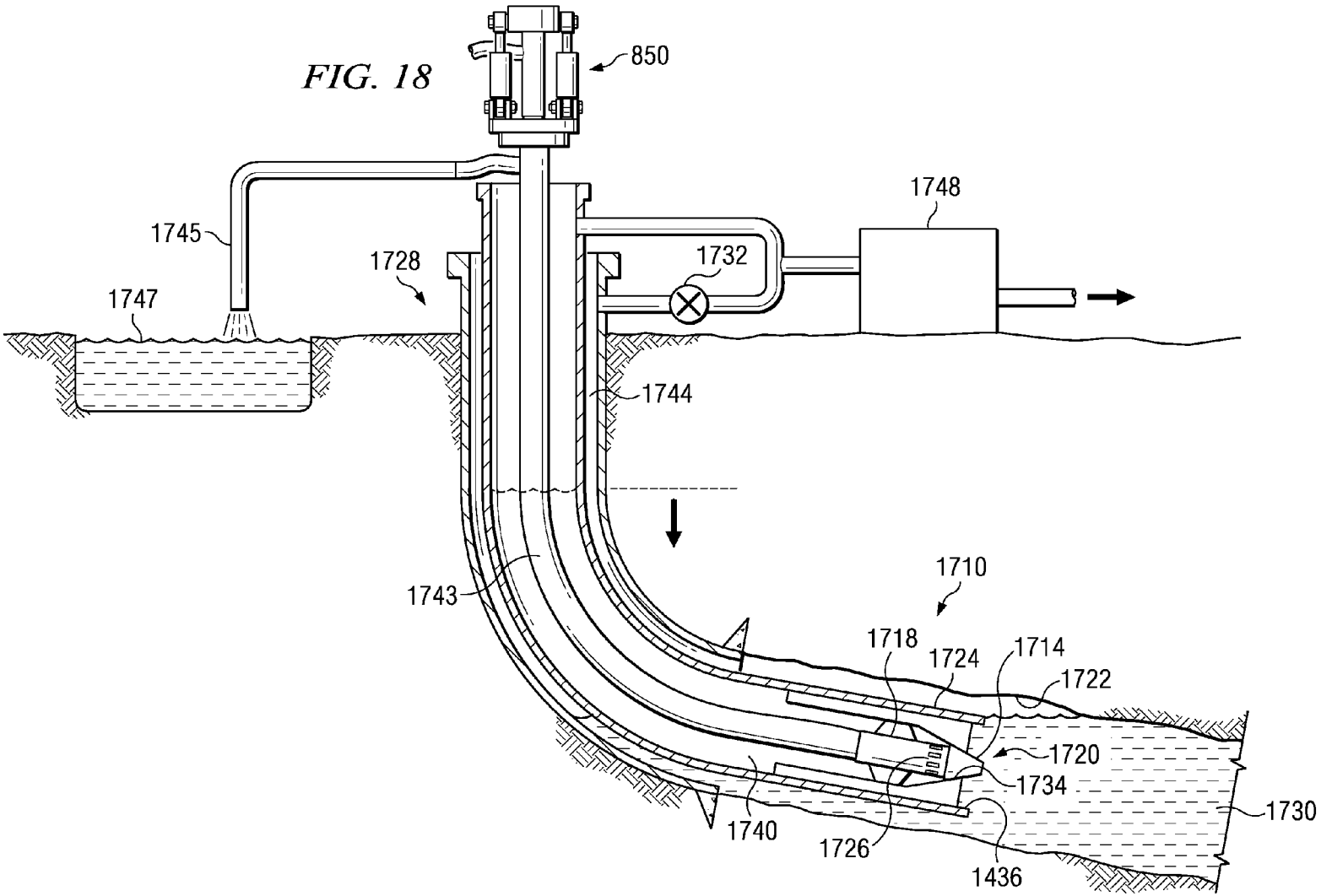
FIG. 18 depicts the flow control system of FIG. 17 with the isolation device being shown in a sealed position during liquid removal.
Figure 19:
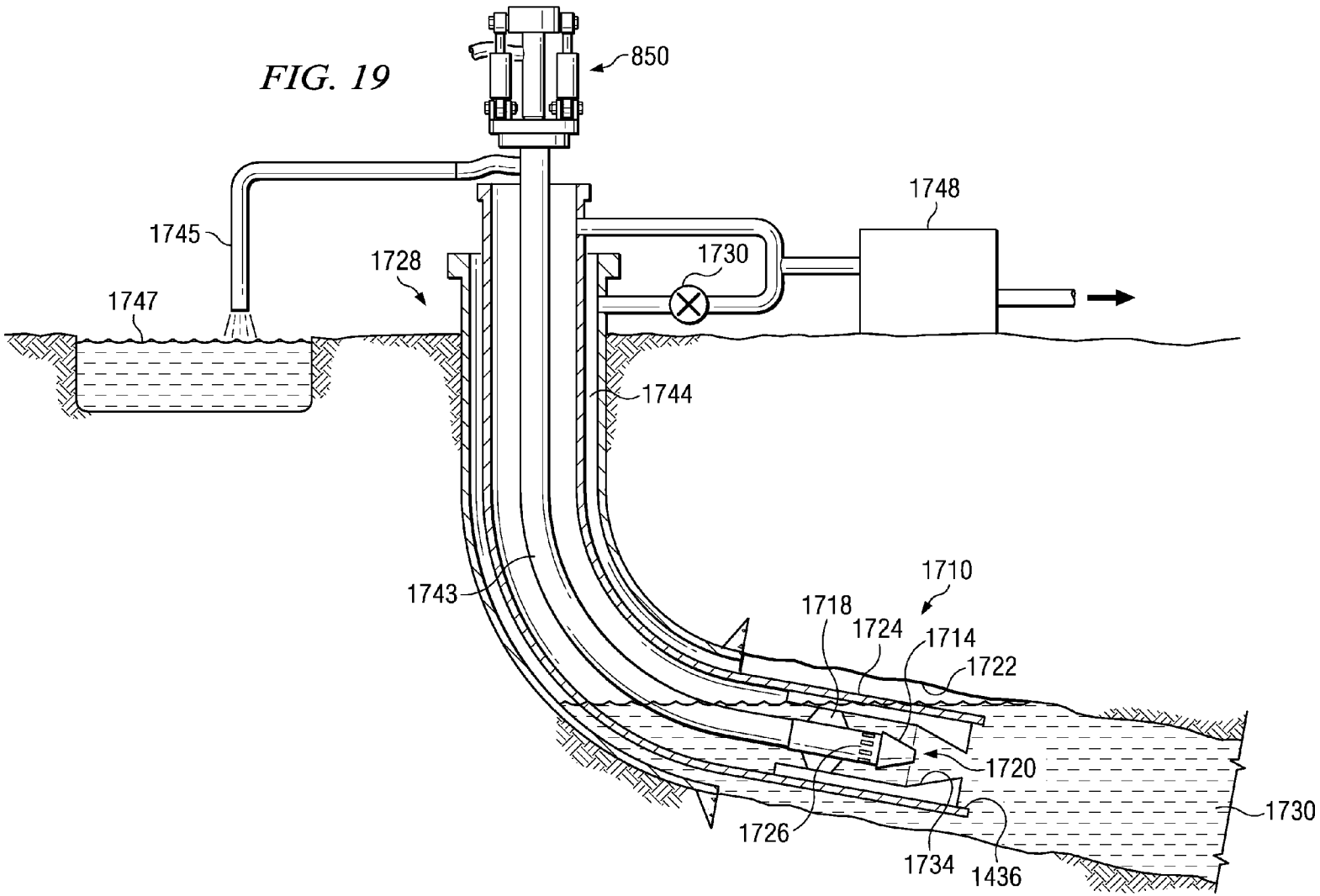
FIG. 19 illustrates the flow control system of FIG. 17 with the isolation device being shown in an unsealed position after liquid removal.

Referring to FIGS. 17-19, a flow control system 1710 according to an illustrative embodiment includes an isolation device, or valve 1720 that is disposed within a tubing string 1724 installed with a well 1728. The isolation device 1720 includes a valve body 1714 operably associated with and/or integrated with a pump 1718 positioned in a substantially horizontal region of a wellbore 1722. The pump 1718 includes a plurality of inlets 1726 to receive liquid 1730 that is present in the wellbore 1712. A tubing string 1743 fluidly communicates with the pump 1718 to allow transport of the liquid 1730 to the surface of the well 1728. At the surface, the tubing string 1743 is fluidly connected to a liquid removal line 1745 that leads to a storage reservoir 1747.

A valve seat 1734 is positioned downhole of the pump 1718, i.e., upstream of the pump relative to the flow of production fluids. The flow of gas within the region of the pump inlets 1726 can be selectively blocked by moving the valve body 1714 into engagement with the valve seat 1734 (see FIG. 18). When the valve body 1714 and valve seat 1734 are engaged, an isolated pump chamber 1740 is formed within the tubing string 1724, thereby substantially reducing or preventing gas flow from the formation from reaching the pump 1718. This reduction or prevention of gas flow at the pump 1718 permits efficient removal of the liquid 1730 that has collected in the pump chamber 1740.

After a sufficient amount of liquid 1730 is removed from the pump chamber 1740, the valve body 1714 may be moved out of engagement with the valve seat 1734 (see FIG. 19). Selective engagement and disengagement of the valve body 1714 and valve 1734 may be controlled from the surface of the well by moving the tubing string 1743 fluidly connected to the pump 1718. The movement of the tubing string 1743 may be accomplished by a using lift system 850, or by any other mechanical or electrical means.

To maximize the level of water directed into the tubing string 1724, an annulus valve 1732 is fluidly connected to a wellbore annulus 1744. Prior to closing the isolation device 1720 by engaging the valve body 1714 and the valve seat 1734, the annulus valve 1732 may be closed to preferentially raise the level of the liquid 1730 in the pump chamber 1740. After isolating the pump 1718 by closing the isolation device 1720, the annulus valve 1732 may be opened such that gas continues to flow through the wellbore annulus 1744 during the pumping cycle, and no additional pressure is exerted against the formation.

When the fluid level has been pumped down to the inlet level of the pump 1718 (see FIG. 19), a pump-off control scheme is utilized to signal the end of the pump cycle. Numerous such control schemes are available for use. One embodiment uses a flow monitoring device that shuts off the power to the pump drive motor upon detecting a drop in the motor current. When the pump 1718 is stopped, the wellhead lift system 850 raises the tubing string 1743, thus disengaging the valve body 1714 from the valve seat 1734, and once again allowing wellbore fluids to flow past the pump 1718.

When the isolation device 1720 is closed, gas is produced through the wellbore annulus 1744 and may be further pressurized at the surface of the well 1728 by a compressor 1748. When the isolation device 1720 is open, gas is produced through either or both of the wellbore annulus 1744 and the tubing string 1724.

Referring now to FIG. 3 and FIGS. 12-19, during the end of the pumping cycle, cavitations of the pump may occur before the fluid has been fully pumped from the well. As such, it may be beneficial to artificially increase the net positive suction head (NPSH) available to the pump by applying gas pressure to the isolated pump chamber. In this configuration, gas pressure from a pressure source such as a compressor is applied to the isolated pump chamber at the beginning of the pump cycle. If desired, at the end of the pump cycle, the applied pressure may be bled-off prior to releasing the pump isolation device.

Figure 20:
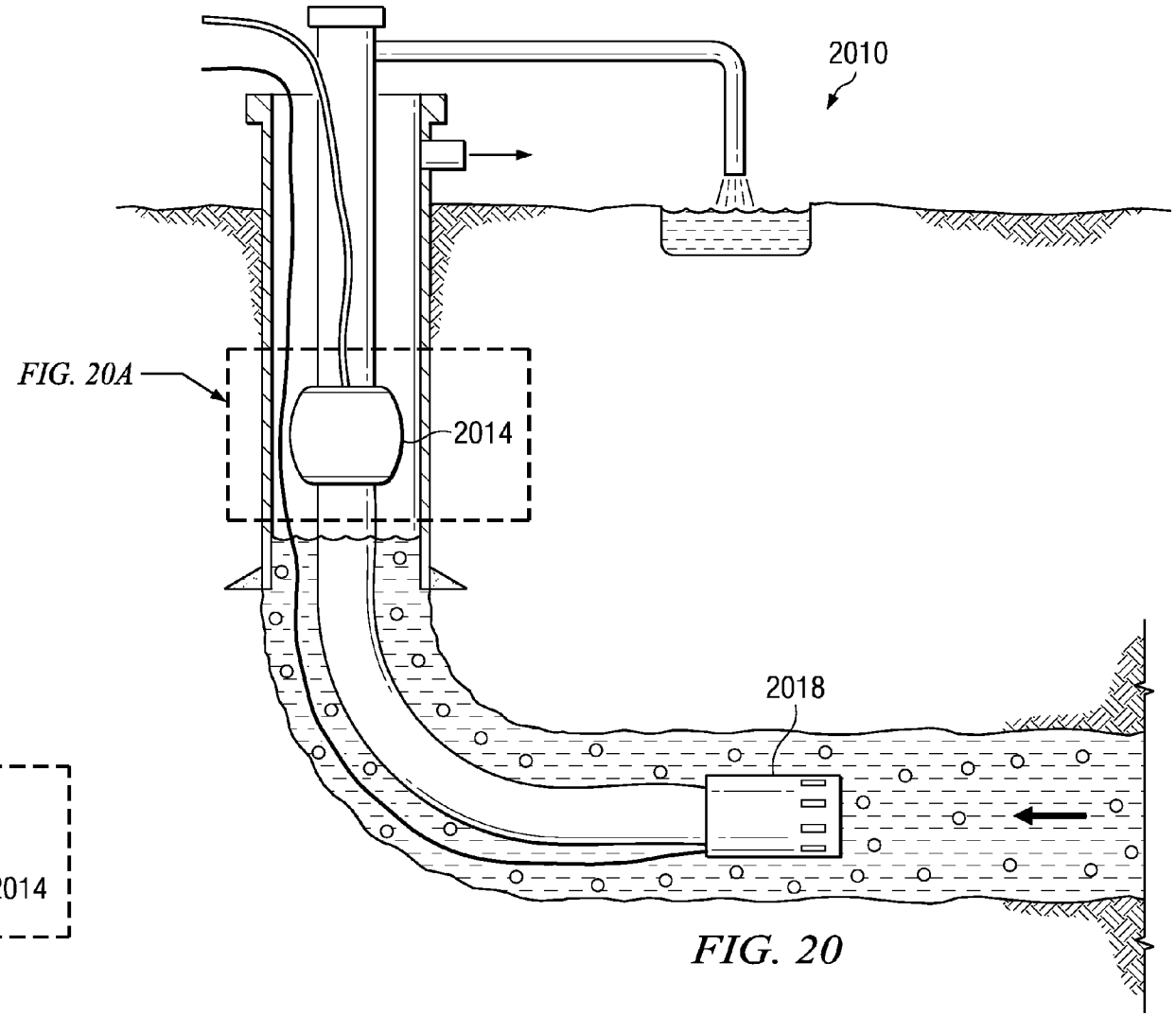
FIG. 20 depicts a flow control system according to an illustrative embodiment, the flow control system having an isolation device positioned uphole of a pump.
Figure 20A:
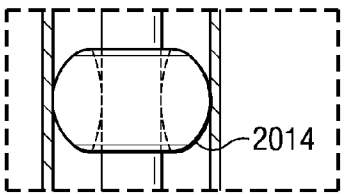

Referring to FIGS. 20 and 20A, a flow control system 2010 according to yet another illustrative embodiment includes an isolation device such as an expandable packer, or sealing element 2014 positioned uphole (i.e. downstream relative to gas flow) of a downhole pump 2018. Preferably, the packer 2014 should be positioned higher than the pump 2018 and/or the horizontal region of the wellbore. In operation, the packer 2014 is inflated to engage the wall of the wellbore prior to operating the pump 2018. When fully expanded, the packer 2014 significantly reduces or eliminates gas flow in the region of the pump 2018. After liquid has been removed from the well, the packer 2014 may be deflated to allow gas production to resume. Selective engagement and disengagement of the packer 2014 against the wall of the wellbore may be controlled from the surface of the well.

Figure 21:
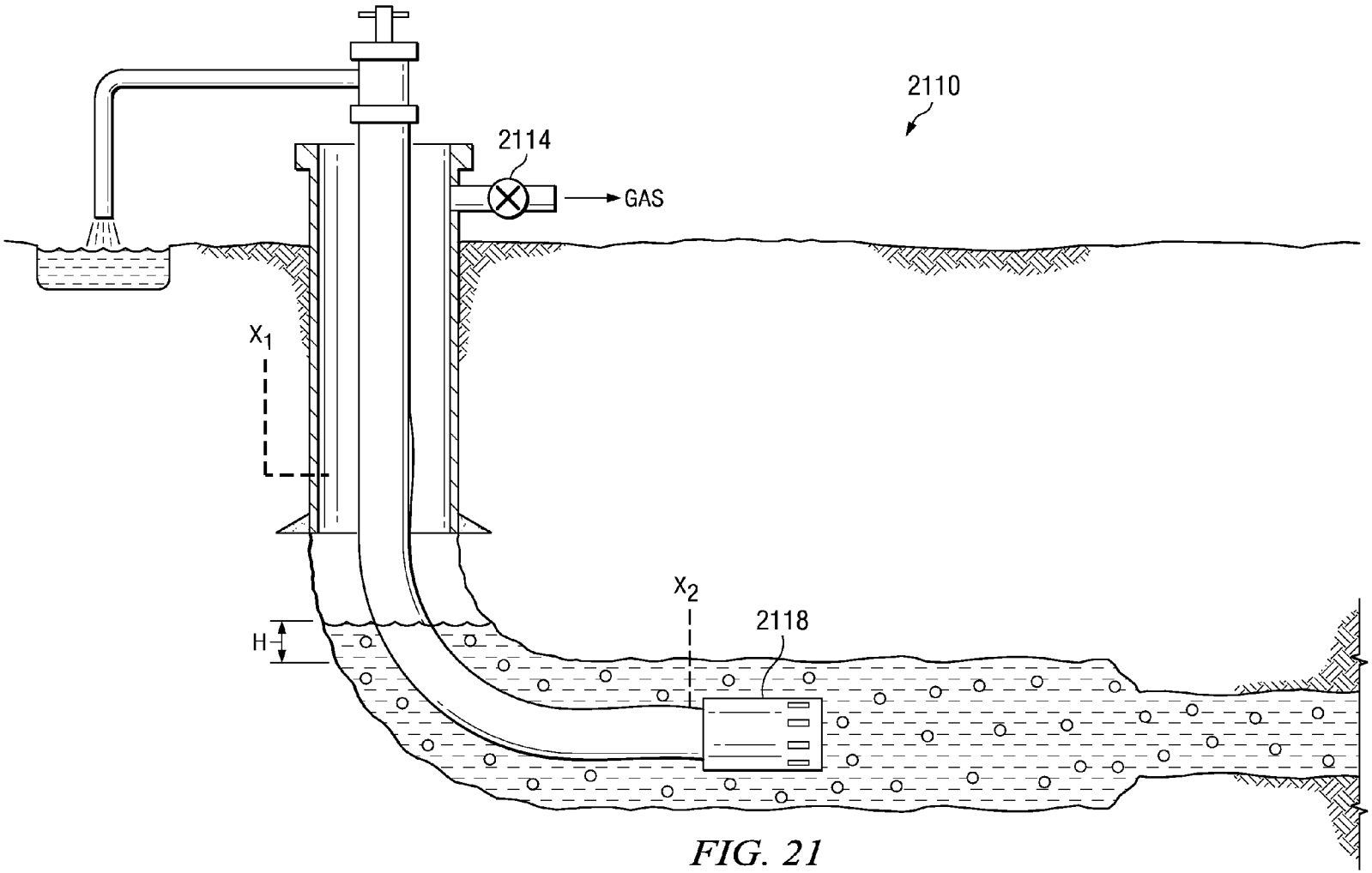
FIG. 21 illustrates a flow control system according to an illustrative embodiment, the flow control system having an isolation device positioned uphole of a pump.

Referring to FIG. 21, in another embodiment, a flow control system 2110 includes an isolation device such as a valve 2114 positioned uphole (i.e. downstream relative to gas flow) of a downhole pump 2118. The valve 2114 may be positioned at or in proximity to the surface of the well. In operation, when liquid needs to be removed from the well, the valve 2114 is closed to slow or block gas flow at the pump 2118. If the casing volume above the pump is significant, gas may continue to flow past the pump 2118 as pressure builds within the casing. Pressures may be monitored above the liquid at X1 and at the pump inlet at X2, and gas may be injected into the annulus of the wellbore at X1 if needed to equalize gas pressure between X1 and X2. Injection of gas downhole of the valve 2114 raises the pressure in the casing and minimizes the pressure differential between X2 and X1, thus further reducing flow of gas past the pump 2114.

Figure 22A:
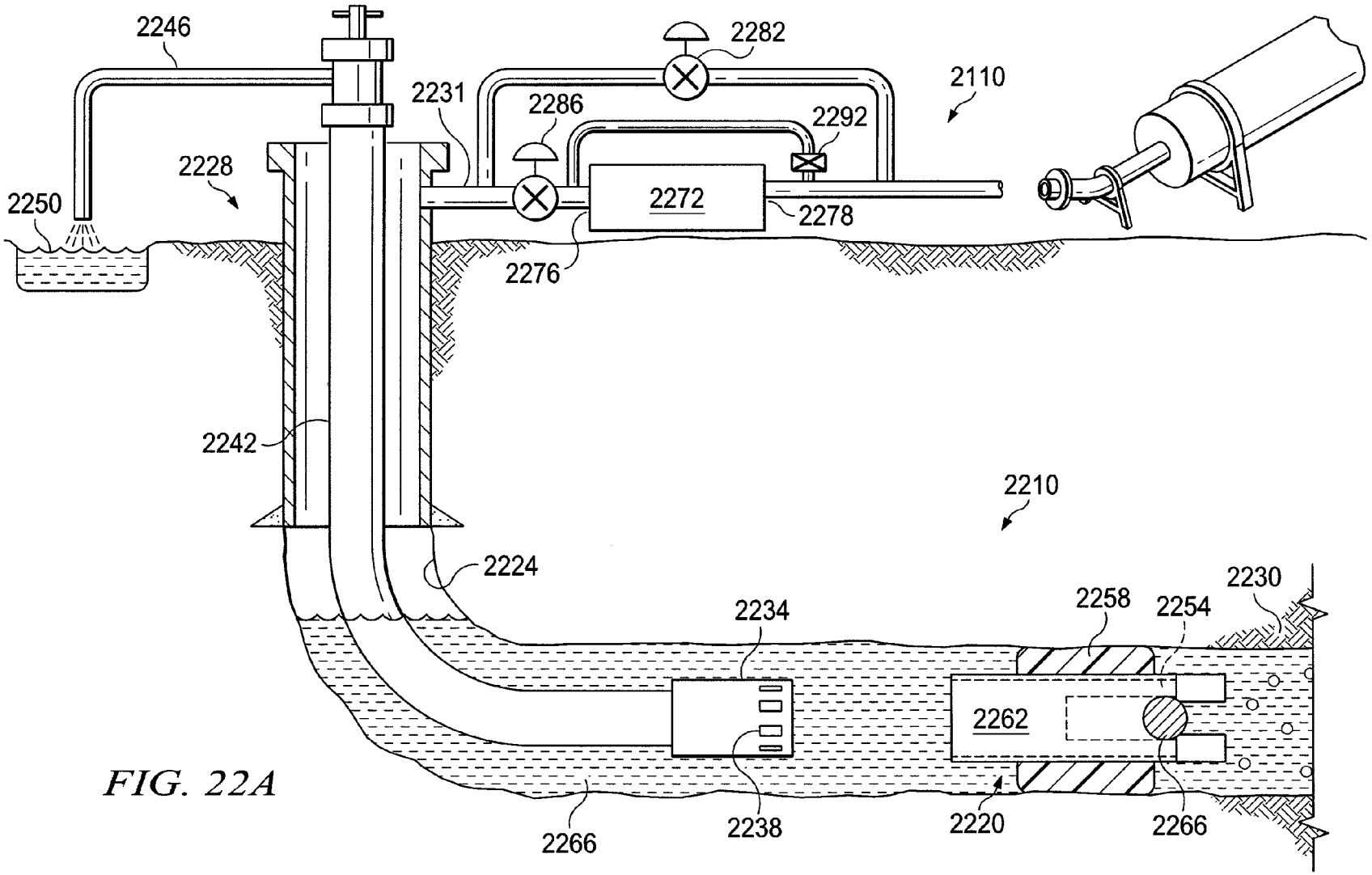
FIGS. 22A-22B depict a flow control system according to an illustrative embodiment, the flow control system having an isolation device including a check valve positioned downhole of a pump.
Figure 22B:
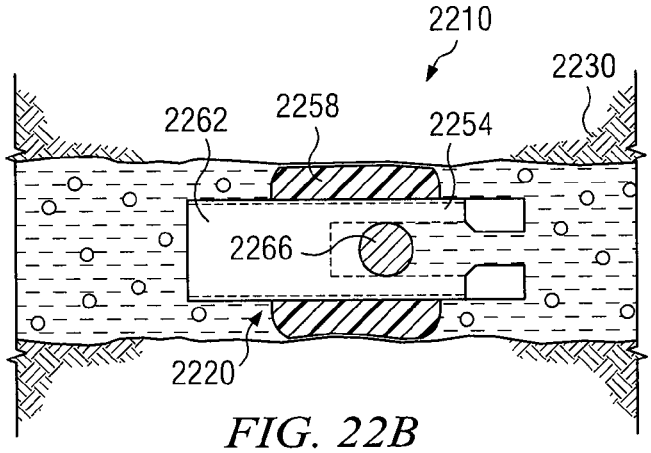

Referring to FIGS. 22A and 22B, a flow control system 2210 according to an illustrative embodiment includes an isolation device 2220 that is disposed within a wellbore 2224 of a well 2228. The well 2228 includes a producing formation 2230 that is capable of producing fluids, which may include liquid 2266 and gas 2268. Gas 2268 produced by the producing formation 2230 may be collected at a surface of the well 2228 through a gas discharge conduit 2231.

A pump 2234 having a plurality of inlets 2238 is positioned within the well, preferably uphole of the isolation device 2220, to remove the liquid 2266 that is present in the wellbore 2224. A tubing string 2242 fluidly communicates with the pump 2234 to allow transport of the liquid 2266 to the surface of the well 2228. At the surface, the tubing string 2242 is fluidly connected to a liquid removal line 2246 that leads to a reservoir 2250.

The isolation device 2220 preferably includes a check valve 2254 positioned downhole of the pump 2234 and uphole of the producing formation 2230. The check valve 2254 includes an open position (see FIG. 22B) in which fluid from the producing formation 2230 is allowed to travel uphole and a closed position (see FIG. 22A) in which fluid from the producing formation is substantially prevented from traveling uphole past the check valve. As illustrated in FIG. 22A, the check valve 2254 may be sealingly secured to the wellbore 2224 of the well 2228 by a sealing element 2258. The sealing element 2258 may be an expandable packer, a mechanical sealing device, or any other type of sealing device that is capable of sealing between the check valve 2254 and either a cased or open wellbore. The check valve 2254 may include a valve body 2262 and a movable ball element 2266 as shown in FIGS. 22A and 22B. Alternatively, the check valve 2254 may comprise a butterfly-type valve, or any other type of valve that is capable of being opened or closed based on a direction of fluid flow at the valve.

In one embodiment, the isolation device 2220 and pump 2234 may be positioned within a substantially horizontal region of the well 2228, but may alternatively be positioned in non-horizontal regions of the well 2228. The isolation device 2220 may be independently positioned and sealed within the wellbore 2224 as illustrated in FIG. 22A, or alternatively, the isolation device 2220 may be operably connected to the pump 2234 and tubing string 2242 such that the isolation device 2220 is positioned within the wellbore 2224 by insertion of the tubing string 2242 and pump 2234.

A compressor 2272 is positioned at the surface of the well 2228 and includes an inlet port 2276 and an outlet port 2278. A second valve 2282 is fluidly connected between the outlet port 2278 of the compressor 2272 and the wellbore 2224. The second valve is positionable in a closed position to prevent gas discharged from the compressor 2272 from entering the wellbore 2224 and an open position to allow gas discharged from the compressor 2272 to enter the wellbore 2224. A third valve 2286 is fluidly connected between the wellbore 2224 and the inlet port 2276 of the compressor 2272. The third valve 2286 is positionable in a closed position to prevent gas from the wellbore 2224 from entering the compressor 2272 and an open position to allow gas from the wellbore 2224 to enter the compressor 2272.

In operation, the check valve 2254 is in the open position to allow normal production of gas 2268 from the producing formation 2230 to the surface of the well 2228. As liquid 2266 builds within the wellbore 2224 and it becomes desirable to pump the liquid from the wellbore 2224, the check valve 2254 is placed in the closed position by introducing compressed gas to the wellbore 2224 uphole of the check valve 2254. The introduction of compressed gas uphole of the check valve 2254 results in a flow of fluid at the check valve 2254 that moves the check valve 2254 into the closed position. In the closed position, the check valve 2254 prevents fluids from the producing formation 2230 from moving past the check valve 2254, which substantially reduces gas flow at the pump 2234. When the check valve 2254 is in the closed position, the pump 2234 may be operated to remove liquid from the wellbore 2224.

The compressor 2272 may be used to introduce compressed gas to the wellbore 2224, or alternatively gas may be routed to the wellbore 2224 from a gas sales line 2288. When the compressor 2272 is operated to introduce gas to the wellbore 2224, the second valve 2282 is placed in the open position, and the third valve 2286 is placed in the closed position. A low-pressure bypass valve 2292 and associated conduit permit continued operation of the compressor 2272 when the third valve 2286 is closed.

Following removal of liquid 2266 by the pump 2234, the second valve 2282 is placed in the closed position, and the third valve 2286 is placed in the open position to resume production of gas from the producing formation 2230 to the surface of the well 2228.

While the embodiment illustrated in FIGS. 22A and 22B is configured such that the isolation device 2220 and pump 2234 are positioned directly within the wellbore 2224 of the well 2228, the isolation device 2220 and pump 2234 may instead be positioned within a separate tubing string similar to tubing string 1724 (see FIG. 17) to allow gas production to continue during isolation of the pump 2234 and removal of liquid by the pump 2234.

While the isolation device 2220 has been described as being positioned downhole of the pump 2234, alternatively, the isolation device 2220 may instead be positioned uphole of the pump 2234 to substantially prevent flow of gas past the isolation device 2220, and due to buildup of pressure downhole of the isolation device 2220, to substantially reduce gas flow at the pump 2234.

Figure 23B:
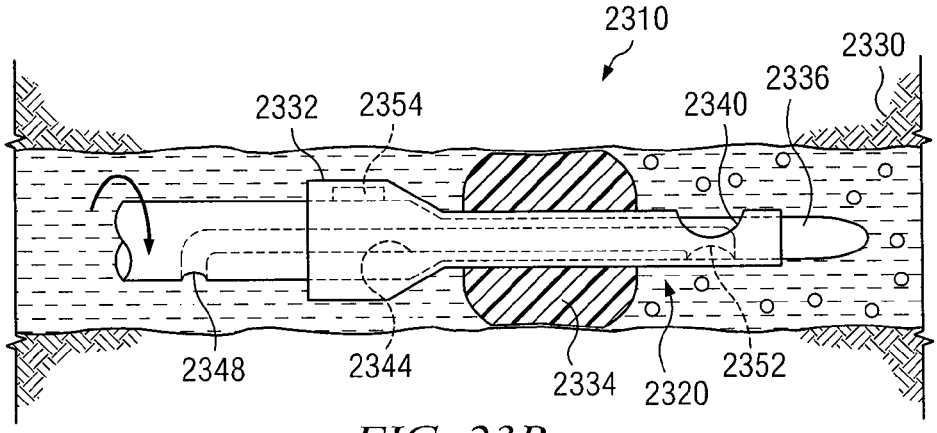
FIGS. 23A-23C illustrate a flow control system according to an illustrative embodiment, the flow control system having an isolation device with rotatable valve elements positioned downhole of a pump.
Figure 23C:
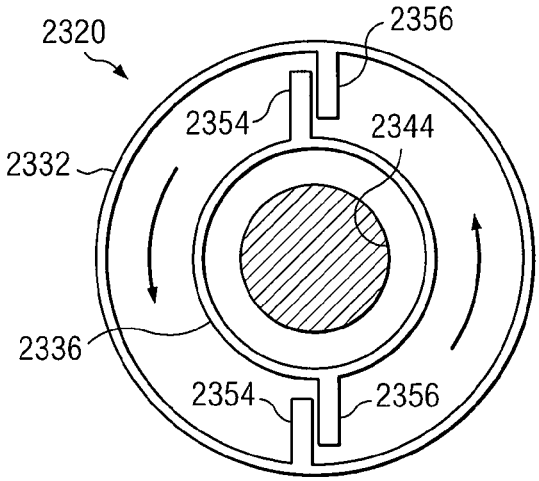
Figure 23A:
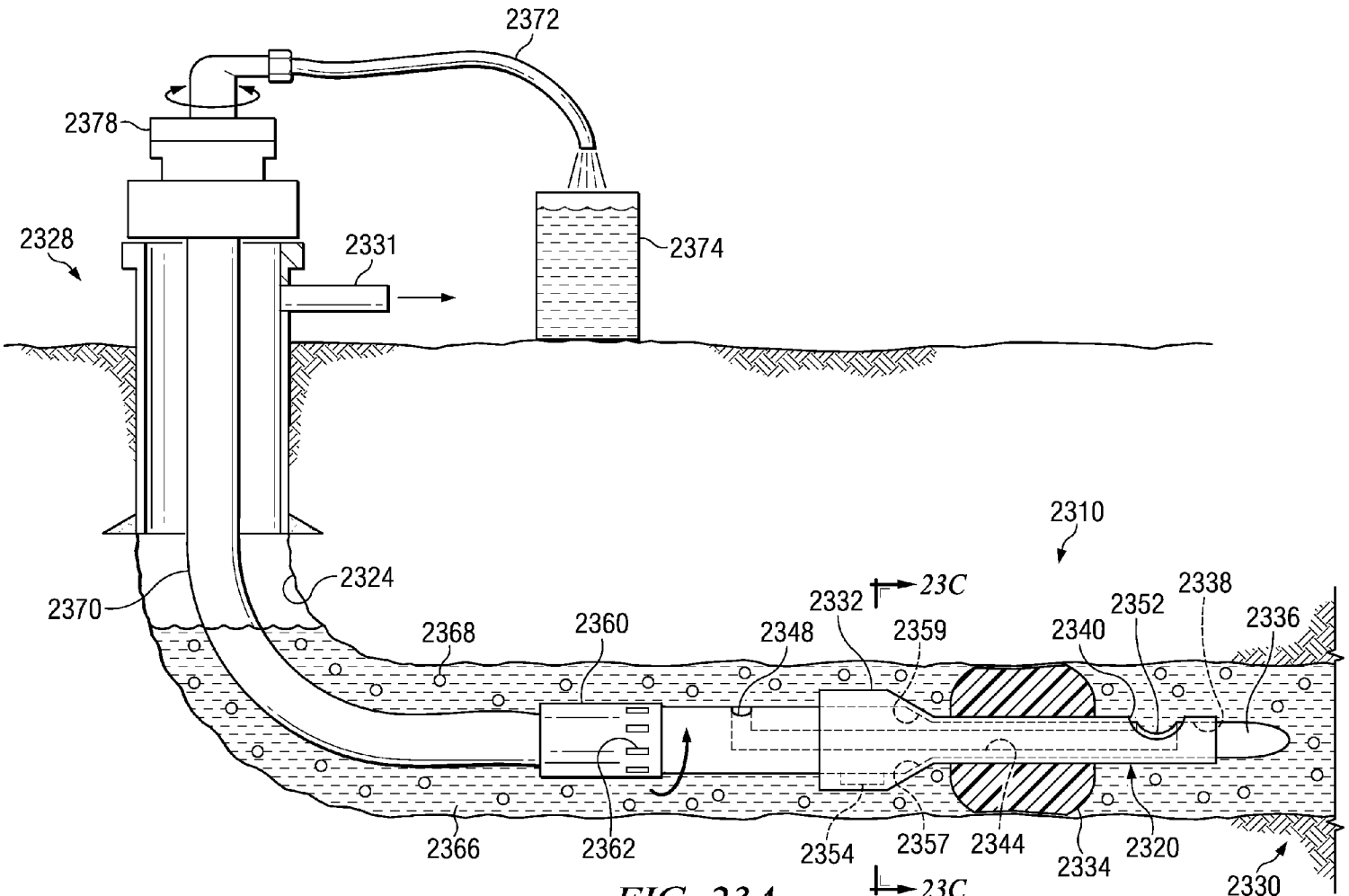

Referring to FIGS. 23A, 23B, and 23C, a flow control system 2310 according to an illustrative embodiment includes an isolation device, or valve 2320 that is disposed within a wellbore 2324 of a well 2328. The well 2328 includes a producing formation 2330 that is capable of producing fluids, which may include liquid 2366 and gas 2368. Gas 2368 produced by the producing formation 2330 may be collected at a surface of the well 2328 through a gas discharge conduit 2331.

In one embodiment, the isolation device 2320 may be positioned within a substantially horizontal region of the well 2328, but may alternatively be positioned in non-horizontal regions of the well 2328. The isolation device 2320 preferably includes a valve body 2332 fixed relative to the wellbore 2324, a sealing element 2334 positioned circumferentially around the valve body 2332 to seal against the wellbore 2324, and a valve spool 2336. The valve body 2332 includes a first passage 2338 and an entry port 2340 fluidly communicating with the first passage 2338. The valve spool 2336 is rotatably received by the first passage 2338 of the valve body 2332. The valve spool 2336 includes a second passage 2344, at least one uphole port 2348 positioned uphole of the sealing element 2334 and fluidly communicating with the second passage 2344, and at least one downhole port 2352 positioned downhole of the sealing element 2334 and fluidly communicating with the second passage 2344. The valve spool 2336 is rotatable between an open position (see FIG. 23A) and a closed position (see FIG. 23B) to allow or prevent flow of fluid from the producing formation 2330 past the sealing element 2334. In the open position, the downhole port 2352 and the entry port 2340 are aligned to allow fluid flow through the second passage 2344, thereby bypassing the sealing element 2334. In the closed position, the downhole port 2352 and the entry port 2340 are misaligned to substantially reduce fluid flow through the second passage 2344, thereby substantially reducing fluid flow past the sealing element 2334.

Referring more specifically to FIG. 23C, a pair of first tabs 2354 is positioned on and extend radially outward from an outer surface of the valve spool 2336, each of the first tabs 2354 being circumferentially positioned about 180 degrees from the other of the first tabs 2354. A pair of second tabs 2356 is positioned on and extend radially inward from an inner surface of the valve body 2332, each of the second tabs 2356 being circumferentially positioned about 180 degrees from the other of the second tabs 2356. The first and second tabs 2354, 2356 engage one another to provide positive alignment of the downhole port 2352 and the entry port 2340 when the valve spool 2336 is in the open position and to ensure misalignment of the downhole port 2352 and the entry port 2340 when the valve spool 2336 is in the closed position. In an alternative embodiment, the valve spool 2336 may be provided with a single tab that alternately engages one of the pair of second tabs 2356 on the valve body 2332. In still another embodiment, the valve body 2332 may be provided with a single tab that alternately engages one of the pair of first tabs 2354 on the valve spool 2336.

While internal seals may be provided between the valve spool 2336 and the valve body 2332 to prevent leakage of fluid when the valve spool 2336 is in the closed position, the valve spool 2336 and valve body 2332 may also be manufactured with tight tolerances to ensure little or no leakage, even in the absence of internal seals.

The valve spool 2336 may include a shoulder 2357 that engages a shoulder 2359 formed on the valve body 2332 when the valve spool 2336 and valve body 2332 are operably assembled downhole. After the valve body 2332 and sealing element 2334 are positioned and fixed downhole, the shoulders 2357, 2359 permit the valve spool 2336 to be properly positioned relative to the valve body 2332 when the valve spool 2336 is inserted into the valve body 2332. The shoulders 2357, 2359 engage one another, which provides a positive axial stop for the valve spool 2336 during insertion into the valve body 2332.

The sealing element 2334 may be an expandable packer, a mechanical sealing device, or any other type of sealing device that is capable of sealing between the valve body 2332 and either a cased or open wellbore.

A pump 2360 having a plurality of inlets 2362 is positioned within the well, preferably uphole of the isolation device 2320, to receive the liquid 2366 that is present in the wellbore 2324. A tubing string 2370 fluidly communicates with the pump 2360 to allow transport of the liquid 2366 to the surface of the well 2328. At the surface, the tubing string 2370 is fluidly connected to a liquid removal line 2372 that leads to a reservoir 2374.

A rotator 2378 driven by a motor is positioned at a surface of the well 2328 and is operably connected to the valve spool 2336 to selectively rotate the valve spool 2336 between the open and closed positions. In one embodiment, the rotator 2378 may be operably connected to the tubing string 2370 to rotate the tubing string 2370 and the pump 2360. The pump 2360 and/or the tubing string 2370 may be operably connected to the valve spool 2336 such that the rotational movement of the tubing string 2370 is imparted to the valve spool 2336.

In operation, the valve spool 2336 is rotated to the closed position when it is desired to operate the pump 2360 to remove the liquid 2366 from the wellbore 2324. The closed position of the valve spool 2336 blocks fluid from the producing formation 2330 from flowing past the isolation device 2320, which substantially reduces gas flow at the pump 2360. When the liquid 2366 has been removed from the wellbore 2324, the pump 2360 may be turned off and the valve spool 2336 rotated back to the open position to allow fluid flow past the isolation device 2320 and thus gas production from the well.

While the embodiment illustrated in FIGS. 23A and 23B is configured such that the isolation device 2320 and pump 2360 are positioned directly within the wellbore 2324 of the well 2328, the isolation device 2320 and pump 2360 may instead be positioned within a separate tubing string similar to tubing string 1724 (see FIG. 17) to allow gas production to continue during isolation of the pump 2360 and removal of liquid by the pump 2360.

While the isolation device 2320 has been described as being positioned downhole of the pump 2360, alternatively, the isolation device 2320 may instead be positioned uphole of the pump 2360 to substantially prevent flow of gas past the isolation device 2320, and due to buildup of pressure downhole of the isolation device 2320, to substantially reduce gas flow at the pump 2360.

In the illustrative embodiments described herein, various isolation devices are employed to reduce the presence or flow of gas at a pump or other liquid removal device. The reduction of gas flow in a region surrounding the pump greatly increases the efficiency of the pump and thus the ability of the pump to remove liquid from the well. It will be appreciated, however, that the gas within the well may originate from a producing formation within the well that may or may not also produce liquid along with the gas. For producing formations that produce both liquid and gas, the gas may be entrained within the liquid, so while the isolation device may be described as substantially reducing gas flow at the pump, it may also be said that the isolation device substantially reduces fluid (i.e. gas and liquid) flow from the producing formation at the pump, or that the isolation device substantially reduces fluid flow past the isolation device. In the case of the illustrative embodiments described herein that include an isolation device positioned between the pump and the producing formation, it may also be said that the isolation device is capable of substantially blocking fluid flow from the producing formation from reaching the pump.

It should be appreciated by a person of ordinary skill in the art that any device or method for removing liquid from a wellbore may be used with the systems and methods described herein, which may include without limitation electrical submersible pumps, hydraulic pumps, piston pumps, reciprocating rod pumps, progressing cavity pumps, or any other type of pump or liquid removal apparatus. In the embodiments described and claimed herein, reference is also made to isolation devices, which may include mechanically-actuated packers, hydraulically-actuated packers, mechanical, electrical and other valves, and other sealing elements. Finally, it should also be appreciated that while the systems and methods of the present invention have been primarily described with reference to downhole water removal, these systems and methods may also be used with other downhole operations where it is desired to isolate a pump from a producing formation. For example, it may be desirable to isolate a pump that is used to pump oil or other liquids when the formation is also gas-producing.

It should be apparent from the foregoing that an invention having significant advantages has been provided. While the invention is shown in only a few of its forms, it is not just limited but is susceptible to various changes and modifications without departing from the spirit thereof.

I claim:

1. A flow control system for removing liquid from a well having a producing formation, the system comprising:

a pump positioned in a wellbore of the well to remove liquid from the wellbore;

a check valve positioned downhole of the pump and uphole of the producing formation, the check valve having an open position in which fluid from the producing formation is allowed to travel uphole and a closed position in which fluid from the producing formation is substantially prevented from traveling uphole;

a compressor positioned at a surface of the well, the compressor having an inlet port and an outlet port;

a second valve fluidly connected between the outlet port of the compressor and the wellbore, the second valve being positionable in a closed position to prevent gas discharged from the compressor from entering the wellbore and an open position to allow gas discharged from the compressor to enter the wellbore; and a third valve fluidly connected between the wellbore and the inlet port of the compressor, the third valve being positionable in a closed position to prevent gas from the wellbore from entering the compressor and an open position to allow gas from the wellbore to enter the compressor.

2. The system of claim 1, wherein the second valve is configured to be in the open position when the third valve is in the closed position.

3. The system of claim 1, wherein during production of gas from the producing formation to the surface of the well, the check valve is in the open position, the second valve is in the closed position, and the third valve is in the open position.

4. The system of claim 1, wherein:

during removal of the liquid from the wellbore, the second valve is in the open position and the third valve is in the closed position to allow gas discharged from the compressor to enter the wellbore; and the gas discharged from the compressor causes fluid flow at the check valve to place the check valve in the closed position.

5. The system of claim 1, wherein:

wherein during production of gas from the producing formation to the surface of the well, the check valve is in the open position, the second valve is in the closed position, and the third valve is in the open position;

during removal of the liquid from the wellbore, the second valve is in the open position and the third valve is in the closed position to allow gas discharged from the compressor to enter the wellbore; and the gas discharged from the compressor causes fluid flow at the check valve to place the check valve in the closed position.

6. A flow control system for removing liquid from a well having a producing formation, the system comprising:

a pump positioned in the well to remove liquid from the well;

a check valve positioned in the well and having an open position and a closed position, the check valve in the open position allowing gas from the producing formation to flow past the check valve, the check valve in the closed position substantially reducing gas flow at the pump from the producing formation; and a compressed gas source in fluid communication with the well to provide compressed gas to move the check valve to the closed position.

7. The system of claim 6, wherein the check valve is positioned downhole of the pump.

8. The system of claim 6, wherein the check valve is positioned uphole of the pump.

9. The system of claim 6, wherein the check valve is positioned between the pump and the producing formation.

10. The system of claim 6, wherein the compressed gas source is a compressor.

11. The system of claim 6, wherein the compressed gas source is a gas sales conduit.

12. The system of claim 6 further comprising a valve in fluid communication between the compressed gas source and the well to selectively allow or prevent the delivery of compressed gas to the well.

13. The system of claim 6, wherein the compressed gas source is positioned at a surface of the well.

14. The system of claim 6, wherein the pump is an electrical submersible pump.

15. The system of claim 6, wherein the pump is a progressing cavity pump.

16. The system of claim 6, wherein the pump is reciprocating rod pump.

17. The system of claim 6 further comprising:

a first tubing string positioned in a wellbore of the well such that an annulus is present between the first tubing string and the wellbore;

a second tubing string positioned within the first tubing string;

wherein the pump is fluid connected to the second tubing string and is positioned within the first tubing string; and wherein the check valve is positioned within the first tubing string downhole of pump to create an isolated pump chamber within the first tubing string when the check valve is in the closed position.

18. The system of claim 17, wherein production of gas from the producing formation continues through the annulus when the check valve is in the closed position.

19. The system of claim 17, wherein the compressed gas source fluidly communicates with the first tubing string to provide the compressed gas to close the check valve.

20. A method for removing liquid from a well having a producing formation, the method comprising:

delivering a compressed gas to the well to close a check valve positioned within the well;

isolating a pump at a downhole location from the producing formation with the closed check valve; and pumping the liquid from the downhole location while the pump is isolated from the producing formation.

21. The method of claim 20, wherein isolating the pump from the producing formation reduces gas flow from the producing formation at the pump.

22. The method of claim 20 further comprising:

continuing to produce gas from the producing formation while the liquid is pumped from the downhole location.

* * * * *